US011536139B2

(12) United States Patent
Lindsey

(10) Patent No.: US 11,536,139 B2
(45) Date of Patent: Dec. 27, 2022

(54) ROTARY PISTON AND CYLINDER WITH THE ROTOR INCLUDING A FORMATION AND BEARING ARRANGEMENT

(71) Applicant: LONTRA LIMITED, Southam (GB)

(72) Inventor: Stephen Francis Lindsey, Southam (GB)

(73) Assignee: Lontra Limited, Warwickshire (GB)

( * ) Notice: Subject to any disclaimer, the term of this patent is extended or adjusted under 35 U.S.C. 154(b) by 971 days.

(21) Appl. No.: 16/329,806

(22) PCT Filed: Sep. 1, 2017

(86) PCT No.: PCT/GB2017/052559
§ 371 (c)(1),
(2) Date: Mar. 1, 2019

(87) PCT Pub. No.: WO2018/042197
PCT Pub. Date: Mar. 8, 2018

(65) Prior Publication Data

US 2019/0195071 A1 Jun. 27, 2019

(30) Foreign Application Priority Data

Sep. 2, 2016 (GB) ..... 1614971

(51) Int. Cl.
*F01C 19/12* (2006.01)
*F01C 3/02* (2006.01)
(Continued)

(52) U.S. Cl.
CPC ..... *F01C 19/125* (2013.01); *F01C 3/025* (2013.01); *F01C 19/02* (2013.01); *F01C 21/02* (2013.01);
(Continued)

(58) Field of Classification Search
CPC ..... F01C 19/125; F01C 3/025; F01C 19/02; F01C 21/02; F01C 21/04; F04C 2240/20; F04C 2250/20
See application file for complete search history.

(56) References Cited

U.S. PATENT DOCUMENTS 5,074,253 A * 12/1991 Dettwiler ..... F01C 9/002 123/297
2011/0174095 A1* 7/2011 Lindsey ..... F01C 3/02 74/63
(Continued)

*Primary Examiner* — Mary Davis
(74) *Attorney, Agent, or Firm* — Rosenberg, Klein & Lee

(57) ABSTRACT

A rotary piston and cylinder device (1) comprising a rotor (2), a stator (4) and a rotatable shutter (3), the rotor comprising a piston (5) which extends from the rotor into a working chamber, the rotor and the stator together defining a working chamber, the shutter arranged to extend through the working chamber and forming a partition therein, and the shutter comprising a slot which allows passage of the piston therethrough, a bearing (20) which mounts the rotor relative to the stator, the rotor comprising a formation (12; 30) which extends substantially axially away from the chamber, and the formation being radially outward of the bearing and extending around the axis of rotation, and the formation comprising a surface which at least in part defines a space between the rotor and the stator, and at least part of that space and/or the formation overlaps in an axial direction with the bearing.

20 Claims, 23 Drawing Sheets

(51) Int. Cl.

| | |
|---|---|
| ***F01C 19/02*** | (2006.01) |
| ***F01C 21/02*** | (2006.01) |
| ***F01C 21/04*** | (2006.01) |

(52) U.S. Cl.
CPC ..... *F01C 21/04* (2013.01); *F04C 2240/20* (2013.01); *F04C 2250/20* (2013.01)

(56) References Cited

U.S. PATENT DOCUMENTS

| | | | | |
|---|---|---|---|---|
| 2017/0204727 | A1* | 7/2017 | Lindsey | F01C 3/025 |
| 2017/0211387 | A1* | 7/2017 | Lindsey | F01C 3/025 |
| 2017/0211388 | A1* | 7/2017 | Lindsey | F01C 3/025 |
| 2019/0242258 | A1* | 8/2019 | Lindsey | F01C 3/025 |

* cited by examiner

ROTARY PISTON AND CYLINDER WITH THE ROTOR INCLUDING A FORMATION AND BEARING ARRANGEMENT

TECHNICAL FIELD

The present invention relates generally to rotary piston and cylinder devices

BACKGROUND

Rotary piston and cylinder devices can take various forms and be used for numerous applications, such as an internal combustion engine, a compressor such as a supercharger or fluid pump, an expander such as a steam engine or turbine replacement, or as another form of positive displacement device.

A rotary piston and cylinder device may be considered to comprise a rotor and a stator, the stator at least partially defining an annular chamber or cylinder space, the rotor may be in the form of a ring or annular (concave in section) surface, and the rotor comprising at least one piston which extends from the rotor into the annular cylinder space, in use the at least one piston is moved circumferentially through the annular cylinder space on rotation of the rotor relative to the stator, the rotor being sealed relative to the stator, and the device further comprising a cylinder space shutter which is capable of being moved relative to the stator to a closed position in which the shutter partitions the annular cylinder space, and to an open position in which the shutter permits passage of the at least one piston, such as by the shutter being rotatably mounted, the cylinder space shutter may be in the form of a shutter disc.

We have devised an improved sealing configuration for such devices.

SUMMARY

According to the invention there is provided a rotary piston and cylinder device comprising a rotor, a stator and a rotatable shutter, the rotor comprising a piston which extends from the rotor into the cylinder space, the rotor and the stator together defining the cylinder space the shutter arranged to extend through the cylinder space and forming a partition therein, and the shutter comprising a slot which allows passage of the piston therethrough, a bearing between the rotor and the stator, the rotor comprising a formation which may extend substantially axially away from the chamber, and the formation may be radially outward of and spaced from the bearing and extending around the axis of rotation, and the formation may comprise a surface which at least in part defines a space between the rotor and the stator, and at least part of that space and/or the formation may overlap in an axial direction with the bearing.

The formation may extend continuously around the axis of rotation of the rotor. The formation is located at a predetermined radius from the axis of rotation.

The device may comprise one or more lubricant fluid seal/s.

The bearing may mount the rotor on the stator.

The bearing may be located between parts that are joined to either the rotor or the stator.

The bearing may comprise a rotatable inner race, which is preferably mounted externally to a shaft portion of the rotor.

The formation and/or the seal may, substantially in its/their entirety, be offset in a radial direction or sense from the bearing. There is preferably substantially no portion of the formation or the seal which is located at a radial distance on which a portion of the bearing is (also) located.

The radial position and extent may be taken relative to an axis of rotation of the rotor.

The formation and/or the seal may in its entirety be located radially outwardly of the bearing. The seal and/or the formation may be at a greater radial position as compared to the radial position of the bearing.

The seal and/or the formation the bearing may be radially non-overlapping. The seal and the bearing may be viewed as being substantially or wholly located at different diameters.

The seal and/or the formation and the bearing need not be aligned with respect to an axial position or extent along the axis of rotation. In that regard, the seal/formation and bearing may be axially offset, although there may be some extent of partial axial registration in which respective portions of the bearing and the seal/formation are located with respect to a common axial location or region along the axis of rotation of the rotor. This may be viewed as partial axial 'overlap', or put differently; at least respective portions or part of each of the seal/formation and the bearing may be differently located with respect to the extent of the axis of rotation. The seal/formation and the bearing may substantially wholly axially overlap. Alternatively, the seal/formation and the bearing may be spaced from each other relative to an axial direction, and not overlap.

The seal, part of an associated seal subassembly or the formation, being at a greater radial position as compared to the bearing, and there being at least some extent of axial overlap between the seal and the bearing, or between the seal subassembly and the bearing may be described as being an overhung arrangement. The formation may be described as being overhung.

The formation may provide a land or surface (on which the seal may be located), or an extension of the land, which axially overlaps the bearing.

The space may be in the form of a path (for example between the seal and the bearing, which may be tortuous or double-back on itself), The seal and the bearing may be located rearwardly of, or behind, the annular chamber. The seal and the bearing may be located to one side of the chamber (when viewed in axial cross-section).

The seal is preferably arranged to substantially prevent fluid from passing therethrough, or the ingress thereof.

The seal is preferably of (continuous) annular, ring or circular form.

The fluid seal may comprise a clearance seal such as close-running surfaces, a labyrinth seal, a helical labyrinth, a wind-back seal or a contact seal such as a lip seal or a mechanical seal or indeed some other form of seal. It will be appreciated that the term seal may include a feature that serves to reduce the volume of fluid flow and may not entirely prevent the flow of fluid through the seal. The seal may be part of a sealing arrangement which comprises a structure around the seal which may, for example, include an extension to a land (around) the seal intended to form a tortuous path or to control the path of fluid in some way (such as an oil flinger).

The seal may be located in the space between the bearing and the stator towards or on a working chamber side of the bearing. The seal may be in communication with the space.

The seal may seal bearing lubricant, other fluid (be it liquid or gas, e.g. water). A fluid sealed may include a working fluid and/or a bearing lubricant.

The bearing lubricant may comprise oil or possibly water, and on the other side of the seal working fluid, such as gas, refrigerant, air or some other fluid, may be present.

The seal may be arranged to substantially maintain an oil-air barrier.

The seal may be arranged to substantially maintain a liquid-working fluid barrier The device may comprise multiple fluid seals. The seals may be of different types. At least one of the seals may be a lubricant seal and at least one of the seals may be a gas seal; however other combinations of fluid seals are possible. The multiple seals may be radially offset from each other, relative to the axis of rotation of the rotor. The seals may radially overlap, may be radially aligned, may be axially aligned, axially offset (with at least partial overlap), or be completely axially spaced. The seals may be arranged to be connected by at least one respective intermediate pathway, formed by a space between the stator and the rotor. The seals may be arranged in series. At least one of the seals may axially overlap with the bearing.

The device may comprise multiple formations, radially spaced from each other.

The space may comprise a channel, passage, pathway or void.

The space may comprise a tortuous or convoluted or circuitous path arrangement or configuration. Where there are multiple seals, a respective space may be provided therebetween. The path defined by the space may comprise portions of different directions or orientations, which together define the overall path. The space may be non-linear (overall) when viewed in axial cross-section. A portion of the space may be directed along a first axial direction and a second portion of the space may be directed along a second axial direction, which is substantially an opposite direction to the extent of the first portion of the space. This may be termed a passageway of the space which doubles back. The spaced may be termed an intermediate space between both the rotor and stator and between the seal and the rotor.

The space need not necessarily be completely open or uninterrupted, and may include a minimal or reduced clearance or opening, located between the bearing and the seal, which allows communication of at least some lubricant therethrough.

A lubricant shield or baffle may be provided in the space, which may be arranged to regulate passage of lubricant to and from the bearing. The shield may be provided adjacent or proximal to the bearing. The shield may be considered as part of a seal subsystem or seal arrangement.

The space may in part be defined by an annular groove, which may be formed on the rotor or by a part attached to the rotor The bearing and the seal may be located between opposing surfaces of the rotor and the stator. This may be termed, in a broad sense, an interface region.

The rotor may comprise a rearward portion which comprises a shaft and extends away from the surface of the rotor which in part defines the working chamber, which is considered as being forward thereof, relative to the axis of rotation of the rotor. The rearward portion may be of generally elongate form. The rearward portion may of tubular or cylindrical or annular form. The rearward portion may be arranged to serve to transmit torque to a transmission assembly between the rotor and the shutter. The rearward portion may comprise a shaft. The rearward part may be axially extending.

The formation may be provided at a rearward portion of the rotor.

The formation may provide a locating or mounting surface for the seal, or be arranged to act in conjunction with the seal. The formation may comprise a flange or a lip, which may be generally orthogonal to the axial extent of the formation.

The formation or rearward part may be considered as an extension of the rotor.

The formation may be described as an annular extension, protrusion or formation of or attached to the rotor.

The formation may over-hang the bearing axially such that the path of the intermediate space in part reverses in the axial direction.

The annular wall may over-hang the bearing axially such that the path of the intermediate space in part reverses in an axial direction. That extent of the space may have a substantially serpentine cross-sectional configuration.

The formation may comprise a portion which, in use, is operative to serve as a lubricant flinger, thrower, slinger or other distributor of fluid.

The device may comprise a fluid collection chamber or space, which may comprise a circularly extending groove or channel, extending about the axis of rotation. The groove or channel may be formed in or defined by the stator. The fluid collection chamber may be arranged to receive fluid from a fluid flinger feature on the rotor.

There may be a drain or other feature to allow fluid to exit or to be removed from the collection chamber. The collection chamber may be in communication with or part of the space.

The term 'piston' is used herein in its widest sense to include, where the context admits, a partition capable of moving relative to a cylinder wall, and such partition need not generally be of substantial thickness in the direction of relative movement but can be in the form of a blade. The partition may be of substantial thickness or may be hollow. The piston may form a partition within the cylinder space. The piston may be arranged to rotate, in use, around the axis of rotation of the rotor.

The term 'seal' is used throughout this text in its widest sense to include allowance for an intentional leak path of fluid, by way of a close-spacing between opposed surfaces, and not necessarily forming a fluid-tight formation. Within this scope a seal may be achieved by way of close-running surfaces or a close-running line or a close-running region. The seal may be provided by a sealing gap between opposing surfaces, to minimise or restrict transmission of fluid therethrough. The sealing gaps corresponding to different surfaces may have varying clearances to their respective opposing parts, due to different assembly and operational requirements.

Although in theory the shutter could be reciprocable, it is preferred to avoid the use of reciprocating components, particularly when high speeds are required, and the shutter preferably comprises one or more rotatable shutters arranged to be positioned substantially in register with the circumferentially- or circularly-extending bore of the annular cylinder space, and is provided with at least one aperture which in the open condition of the shutter permits passage of the at least one piston therethrough.

The rotor and stator may define a working chamber. A surface of the rotor which in part defines the working chamber may be concave or curved in cross-section. The working chamber may be of substantially annular form.

The shutter may present a partition which extends substantially radially of the cylinder space.

The at least one aperture of the shutter may be provided substantially radially in, and with respect to, the shutter.

Preferably the axis of rotation of the rotor is non-parallel to the axis of rotation of the shutter. Most preferably the axis of rotation of the rotor is substantially orthogonal to the axis of rotation of the shutter.

Preferably the piston is so shaped that it will pass through an aperture in the moving shutter, without balking, as the aperture passes through the annular cylinder space. The piston may be shaped so that there is minimal clearance between the piston and the aperture in the shutter, such that a seal is formed as the piston passes through the aperture.

The rotor may be rotatably supported by the stator rather than relying on co-operation between the piston and the cylinder walls to relatively position the rotor body and stator. It will be appreciated that a rotary piston and cylinder device is distinct from a conventional reciprocating piston device in which the piston is maintained coaxial with the cylinder by suitable piston rings or lands which give rise to relatively high friction forces.

The rotor may be rotatably supported by a suitable bearing carried by the stator or stator assembly.

The bearing may be located between parts that are joined to either the rotor or the stator.

Preferably the stator comprises at least one or more ports. There may be at least one port for inlet flow, and at least one port for outlet flow.

At least one of the ports may be substantially adjacent to the shutter.

At least one of the ports may be positioned such as to form a valved port in cooperation with a port in the rotor.

Preferably the ratio of the angular velocity of the rotor to the angular velocity of the shutter disc is 1:1, although other ratios are possible.

The device may be of a type in which the chamber-defining rotor surface is directed or faces generally outwardly of the axis of rotation of the rotor. The device may also be of a type in which the chamber-defining rotor surface is directed or faces generally inwardly towards the axis of rotation of the rotor.

The shutter may be arranged to extend through or intersect the working chamber at (only) one region or location of the cylinder space.

The device, and any feature of the device, may comprise one or more structural or functional characteristics described in the description below and/or shown in the drawings.

BRIEF DESCRIPTION OF DRAWINGS

Various embodiments of the invention will now be described, by way of example only, with reference to the following drawings in which.

DETAILED DESCRIPTION

Figure 1:
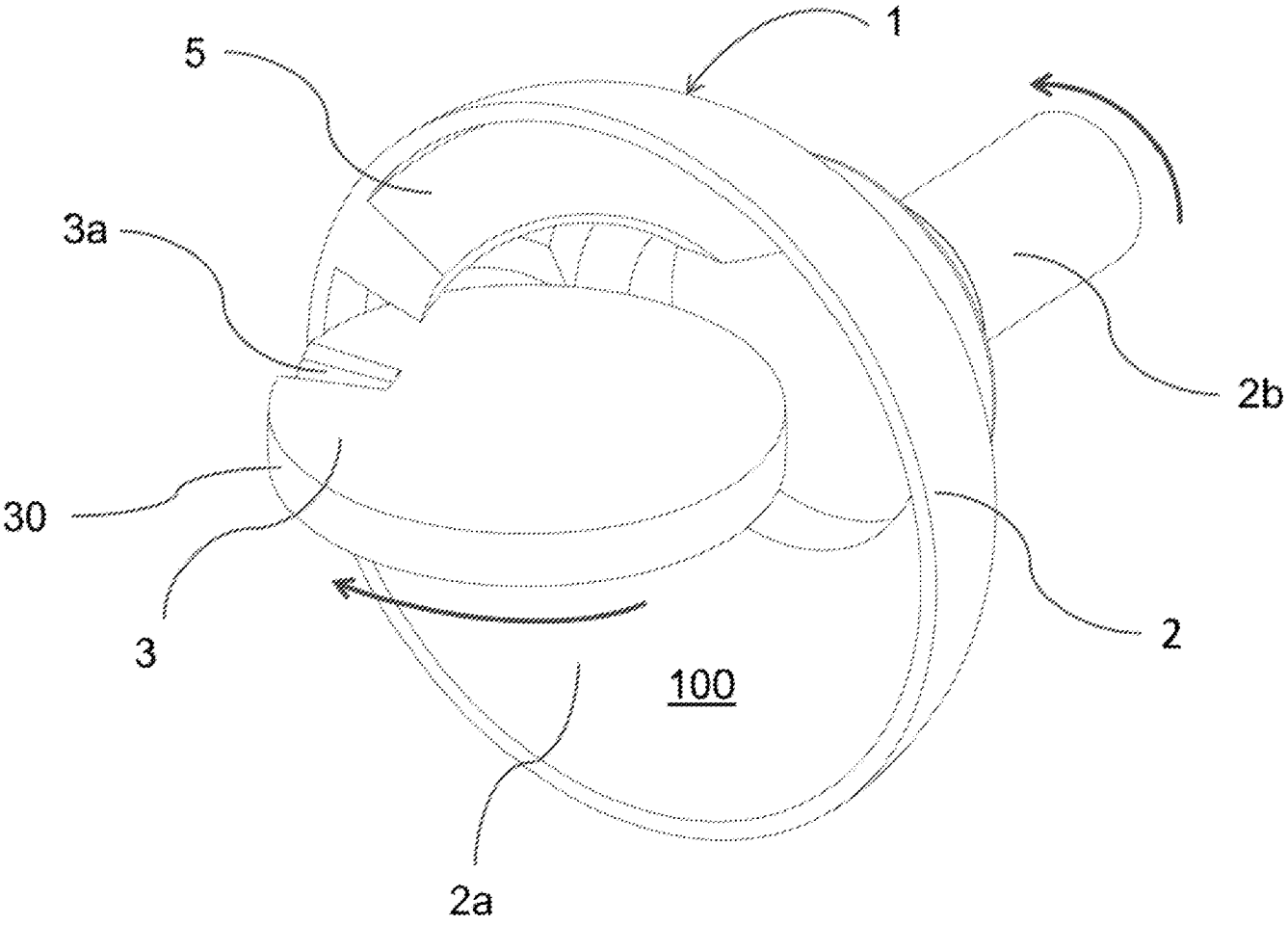
FIG. 1 is a front simplified perspective view of a rotary piston and cylinder device
Figure 2:
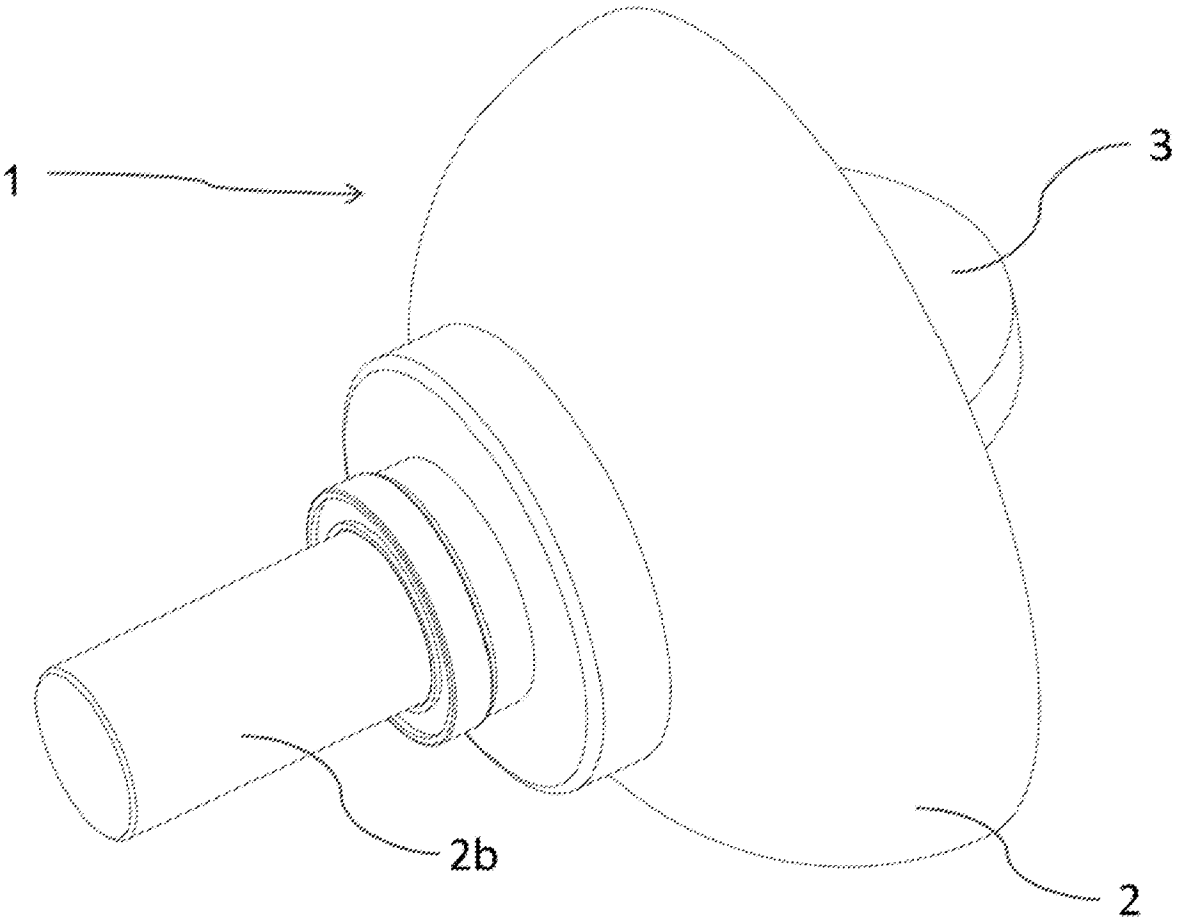
FIG. 2, is a rear simplified perspective view of a rotary piston and cylinder device, FIGS. 3 to 15 each show partial longitudinal cross-sections of various embodiments of a rotary piston and cylinder device, which are based on the type of rotary piston and cylinder device disclosed in FIGS. 1 and 2.

Reference is made to FIGS. 1 and 2 which shows a rotary piston and cylinder device 1 which comprises a rotor 2, a stator 4, and a shutter disc 3. The stator, although not shown in FIGS. 1 and 2 for ease of representation, but shown in part in the further Figures, comprises a formation, such as a housing or casing, which is maintained relative to the rotor, and surface of the stator facing the surface 2*a* of the rotor, together define a cylinder space or working chamber, shown generally as 100. The stator 4 may further comprise a second portion which is located to the other side of the rotor, and so the stator portions together enclose the rotor therebetween. (It will be noted that part of the stator which encloses the working chamber is omitted from the drawings for reasons of simplification.) Integral with the rotor and extending from the surface 2*a* there is provided a piston 5. A slot 3*a* provided in the shutter disc 3 is sized and shaped to allow passage of the blade therethrough. Rotation of the shutter disc 3 is geared to the rotor by way of a transmission assembly (not shown) which comprises gearing which is arranged to ensure that the timing of the rotor remains in synchrony with the shutter disc.

In use of the device, a circumferential surface 30 of the shutter disc faces the surface 2*a* of the rotor so as to provide a seal therebetween, and so enable the shutter disc to functionally serve as a partition within the annular cylinder space.

The geometry of the surface 2*a* of the rotor is governed by the curved circumferential surface of the rotating shutter disc. Since the disc (preferably) penetrates/intersects only one side of the (annular) chamber, the axes of the disc and rotor will not generally intersect.

The rotor and the stator are configured to provide the annular cylinder space with an inlet port and an outlet port (not referenced) for the particular fluid.

The rotor 2 further comprises a rearwardly extending portion 2*b*, which is located rearwardly of the cylinder space. The rearward portion 2*b* may be thought of as a shaft, which is arranged to transmit torque to or from the rotor, in use.

As will be described below, a seal separates the bearings from the rotor on the side of the chamber. This may serve to separate the bearing lubricant from the working fluid (for example air) or the bearing lubricant from the rotor itself or the working fluid (possibly corrosive gas) from the bearings, and the embodiments below disclose an advantageous way of arranging the seal and the bearing.

In the specific description of the embodiments which follow, the same reference numerals are used where the same or substantially the same feature, or equivalent feature (from either a functional and/or structural perspective) is referred to.

Figure 3:
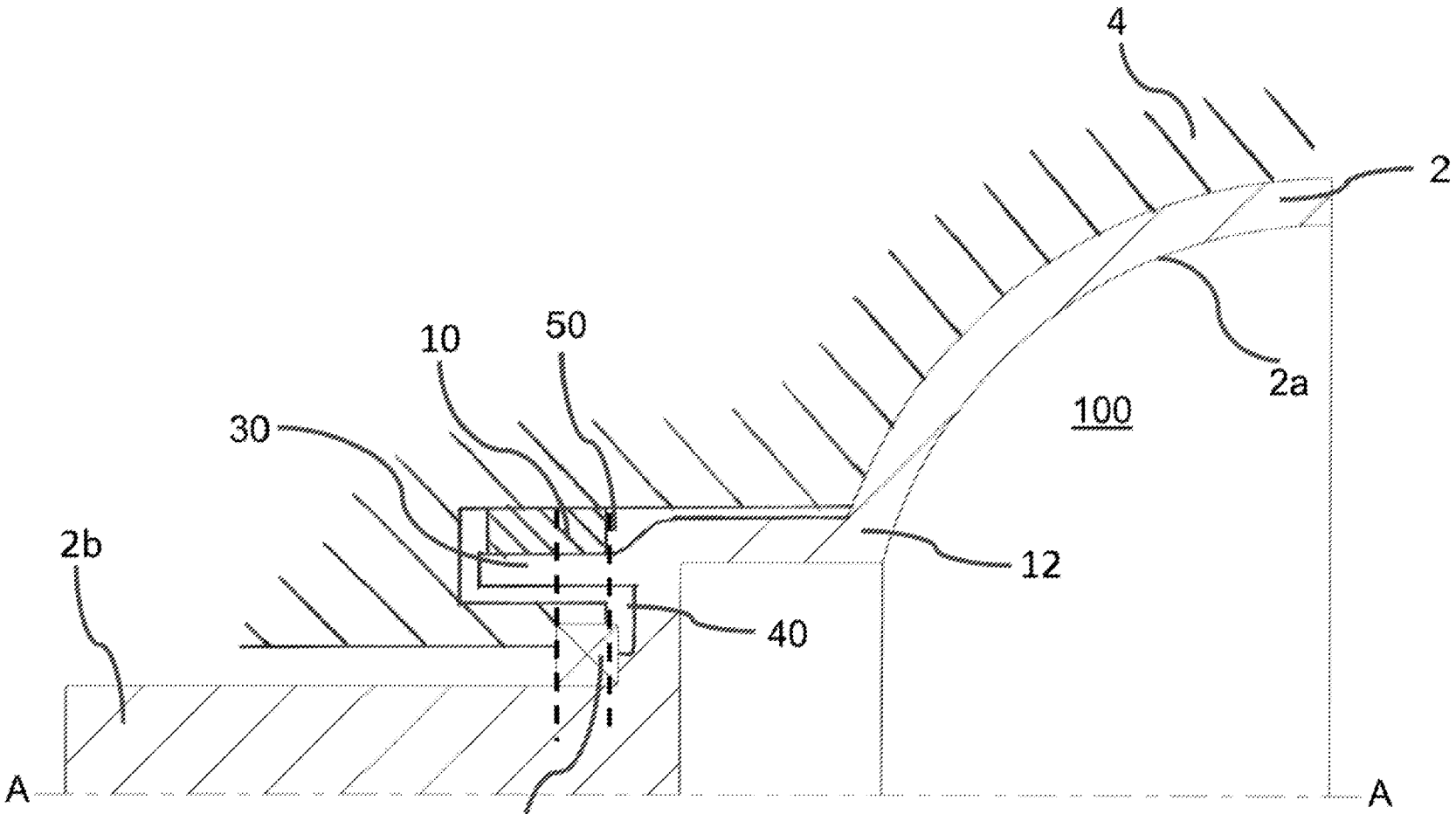

With reference now to FIG. 3, there is shown a partial cross-sectional view of a rotary piston and cylinder device, which comprises a fluid or lubricant seal 10 and a bearing 20, which rotationally mounts the rotor 2 to the stator 4, and which can be said to occupy an interface region between the rotor 2 and the stator 4. As can be seen, the seal 10 is located at a radially outermost position as compared to the bearing 20, which is located radially inwardly, both radial positions determined relative to an axis of rotation A-A of the rotor 2. This general characteristic of offsetting, spacing or clearance in a radial sense between the bearing 20 and the seal 10 is common to the embodiments which follow, and all serve to illustrate some of the ways in which this principle can beneficially be realised.

The device further comprises an annular wall 30 which is located rearwardly of the cylinder space 100. The annular wall 30 provides a land or surface on which the seal 10 is located, or a surface with which or on which the seal acts, and is also radially spaced from the bearing. It will be appreciated that the seal 10 is of substantially annular or circular form. Whilst it is primarily intended that the annular wall 30 is formed integrally with the rotor at the time of manufacture, in some embodiments, it may be a separate component which is affixed to the (major portion) of the rotor during a post-manufacture assembly process (and in relation to which one of the embodiments which follows relates).

Further in relation to the embodiment shown in FIG. 3 the annular wall 30 can be seen to extend from a rearward portion 12 of the rotor.

The convoluted and tortuous configuration of a space 40, which is defined between the rotor and the stator, is such as to add additional sealing or fluid control between the bearing 20 and the fluid seal 10. Part of the space 40 is defined by the formation 30. The space advantageously serves to minimise the fluid which moves or flows towards the seal 10. It will be appreciated that the principal purpose of the seal 10 is to prevent the ingress or passage of fluid into the space 50, which may be filled with air or other working fluid, and which lies at an opposite side of the seal 10. Both the seal 10 and the bearing 20 are in communication with the intermediate space 40.

As shown in broken line in FIG. 3, there is at least partial axial overlap between the seal 10 and the bearing 20, and indeed axial overlap between a portion of the space 40 and the bearing 20.

Figure 3A:
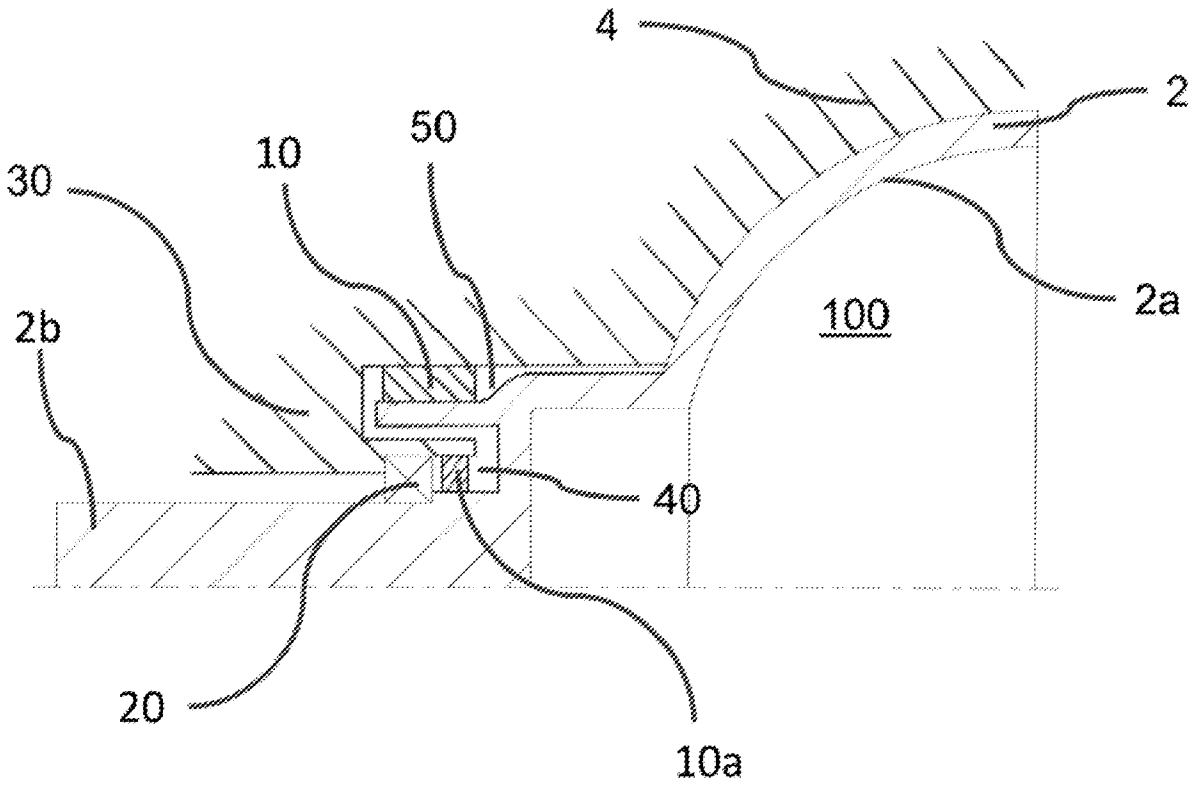

FIG. 3*a* shows a variant embodiment to that of FIG. 3, in which an additional fluid restriction feature 10*a* is included in the space 40. The restriction may comprise a fluid seal or an oil shield.

Figure 4:
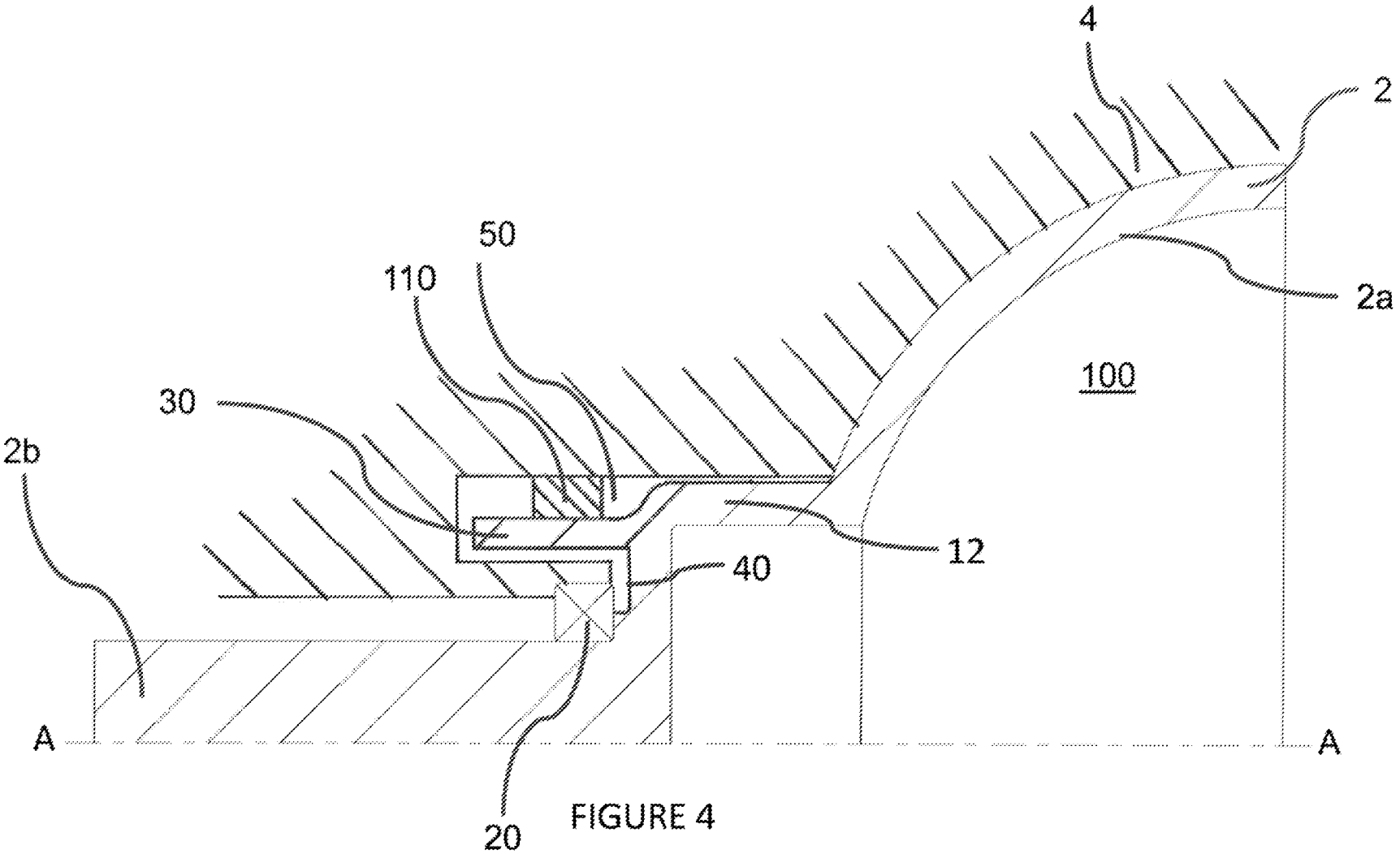

Reference is now made to FIG. 4 shorter (in an axial direction) seal 110 is provided. The seal 110 could be re-positioned all the way axially away from the working chamber (left in FIG. 4) so that it does not overlap the bearing 20 axially but that it is substantially over-hung (with respect to the bearing) and giving a path to the space that over-laps the bearing.

Figure 5:
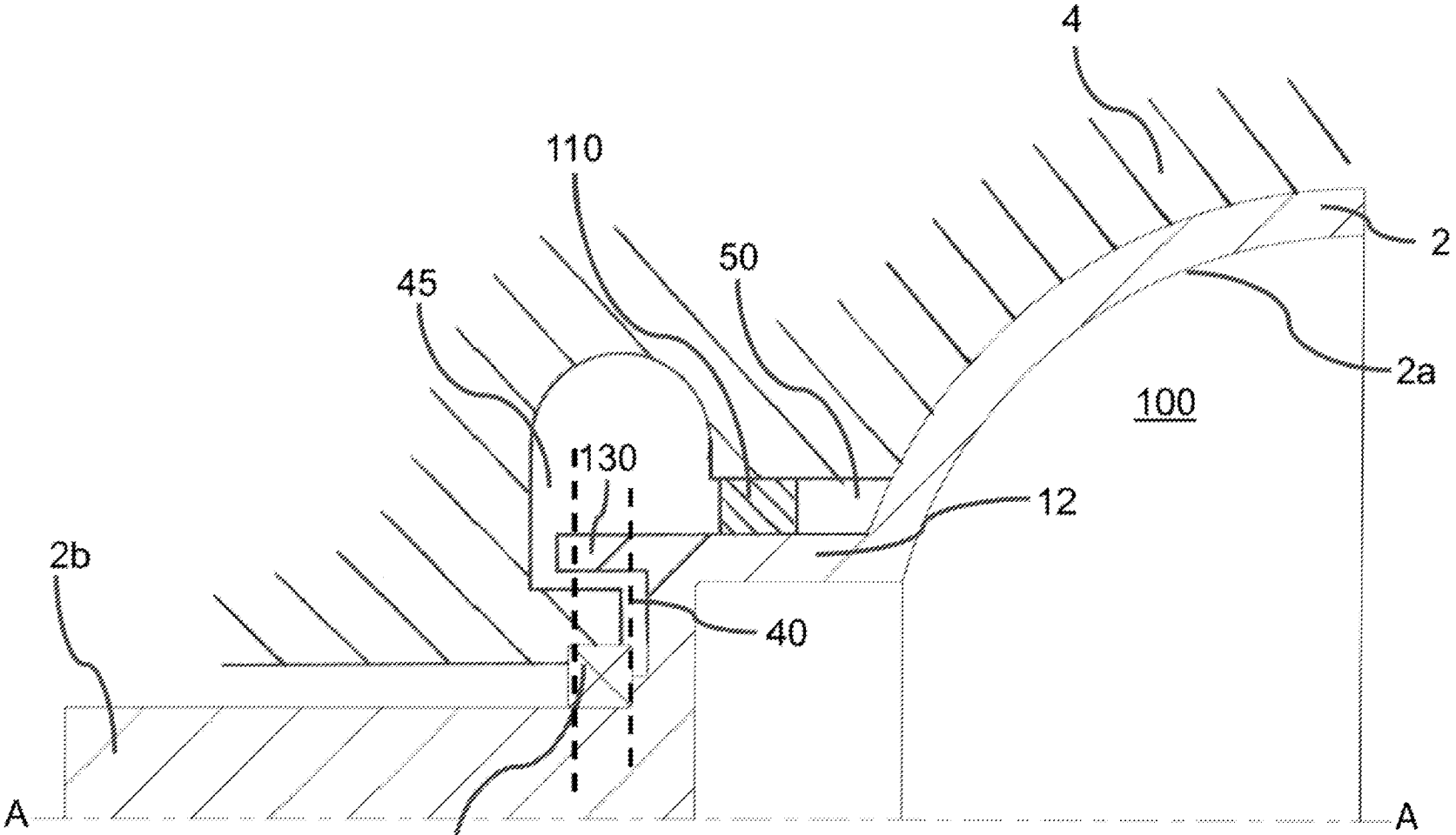
Figure 6:
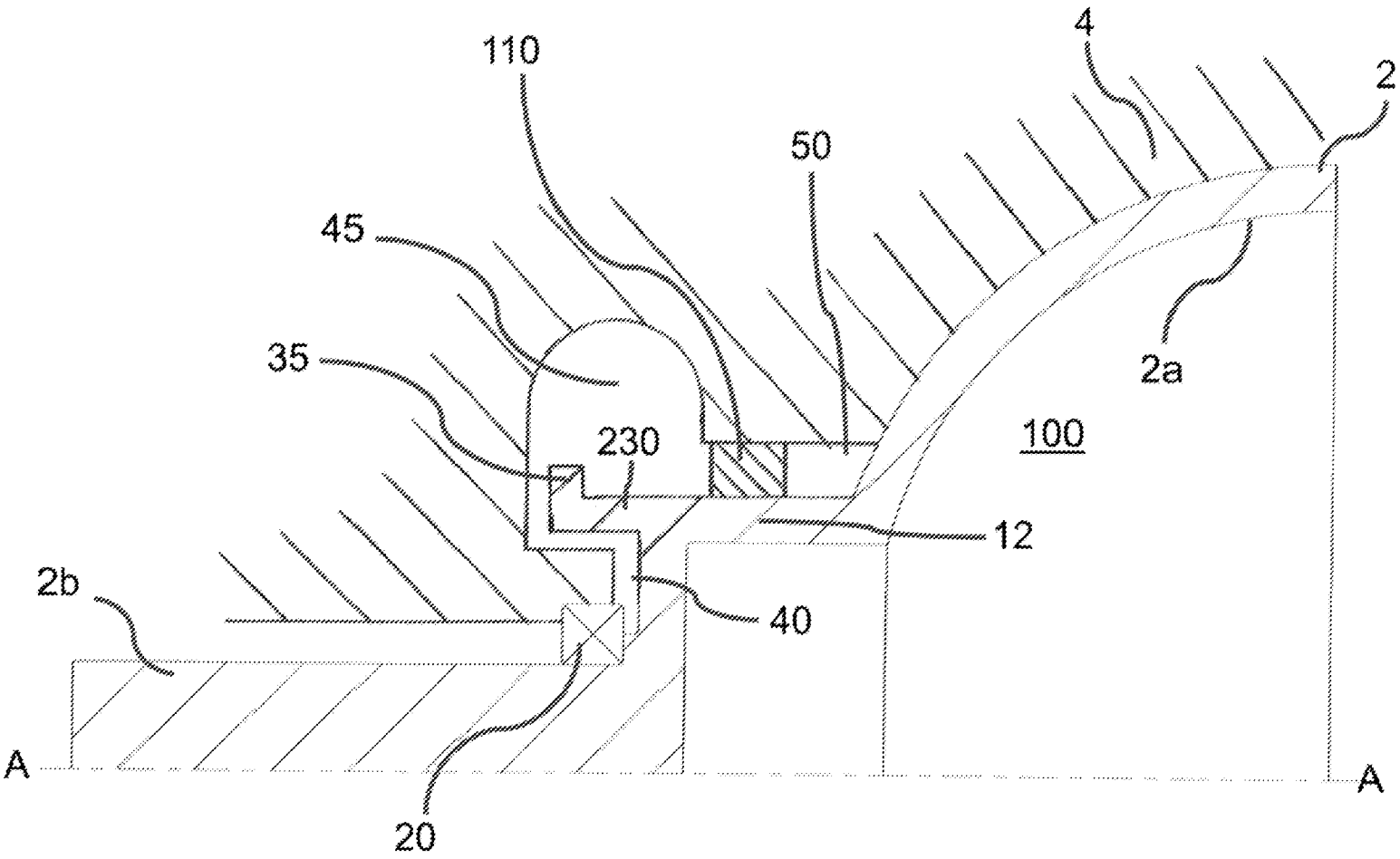

Reference is now made to FIGS. 5 and 6 in which what may be termed an intermediate region comprises the space 40 as well as a fluid collection sub chamber 45 which is in part defined by a curved or shaped groove as seen in the cross sectional views of FIGS. 5 and 6, formed in the stator. It is also to be noted that in FIG. 5 the fluid seal 110 is now set axially forwardly (relative to the above described embodiment and towards the working chamber 100) so that the radially outer surface or land of the annular wall 130 is clear of the fluid seal 110. The bearing 20 and the seal 110 are located with respect to different positions along the axis A-A. The land 130, the path 40 and space 45, (at least in part) axially overlap the bearing. Those axially overlapping features could be considered as parts of the overall sealing system or sealing arrangement.

In the variant but related embodiment shown in FIG. 6 this includes an annular wall 230 which is provided with a lip or flange feature 35. The feature 35 serves as an oil flinger, slinger or thrower in order to direct/distribute oil into the curved or shaped groove recess 45. The recess, or sub-chamber 45, may be considered as part of the intermediate space 40. It will be appreciated that the lip of flange feature 35 may, during the assembly of the rotary piston and cylinder device, be a separate component which is attached to the rotor during assembly.

Figure 6A:
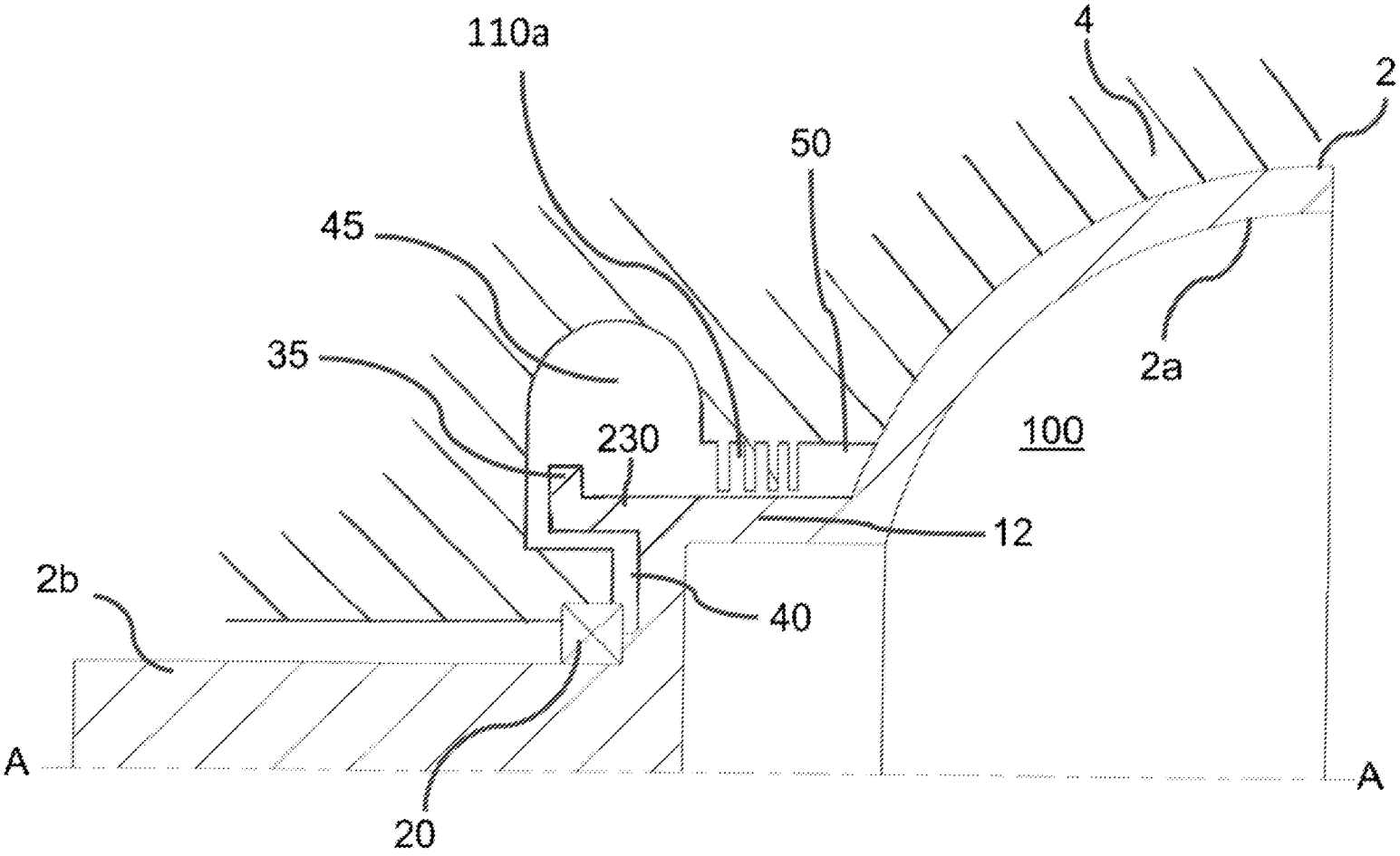
Figure 6B:
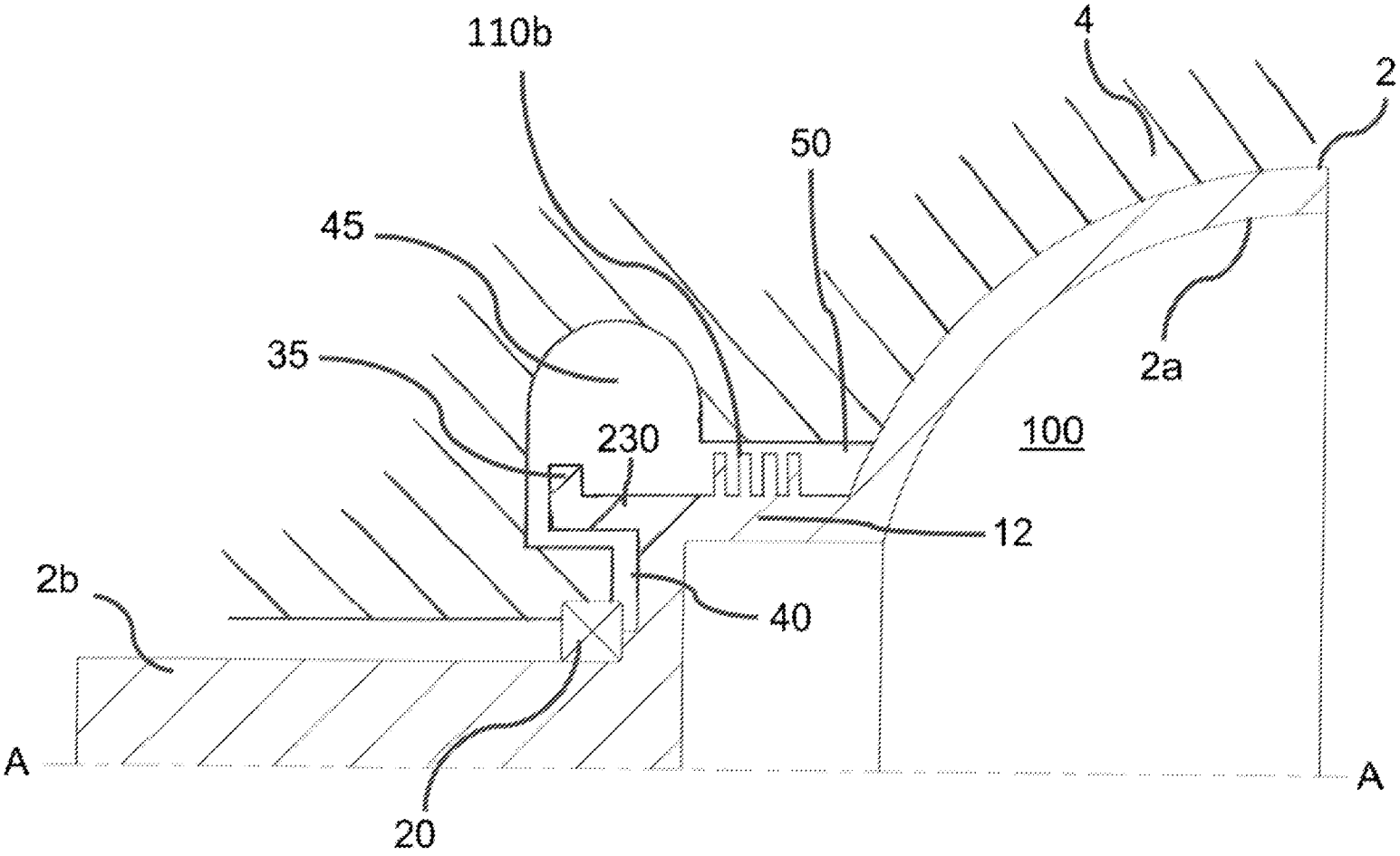
Figure 6C:
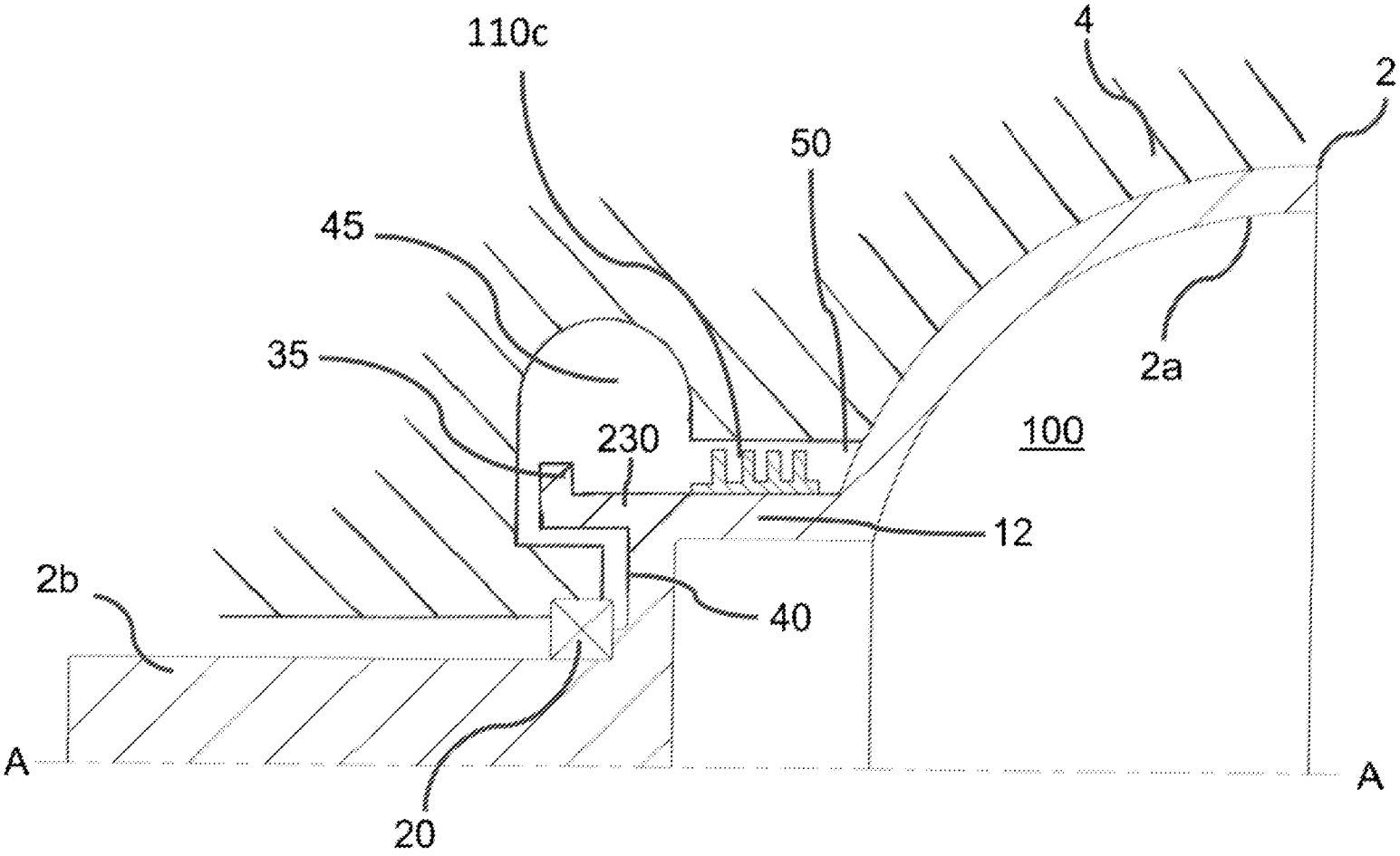
Figure 6D:
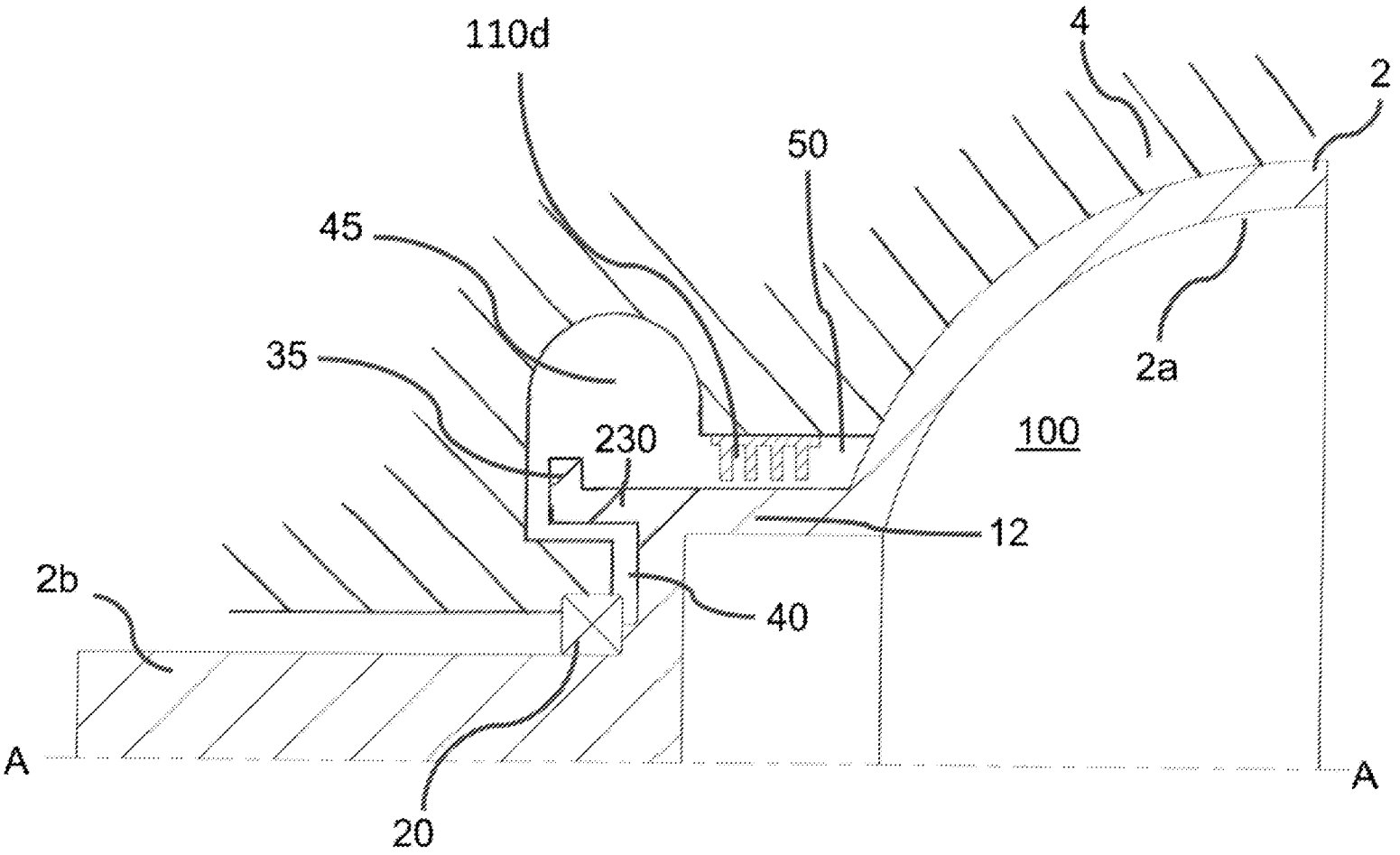

FIGS. 6*a* to 6*d* show further embodiments which include a labyrinth seal is included. In FIG. 6*a*, the labyrinth seal 110*a* is formed as being integral with the stator 4. In FIG. 6*b*, a labyrinth seal 110*b* is formed as being integral with the rotor 2. In FIG. 6*c*, a labyrinth seal 110*c* is provided as a separate component which is secured to the rotor 2, and in FIG. 6*d*, a labyrinth seal 110*d* is a separate component which is secured to the stator 4. Note that in all of FIGS. 6*a* to 6*d*, the labyrinth seal is axially offset from the bearing 20. However, part of the annular wall/land 230, and part of the intermediate space, nevertheless overhangs the bearing.

Figure 7:
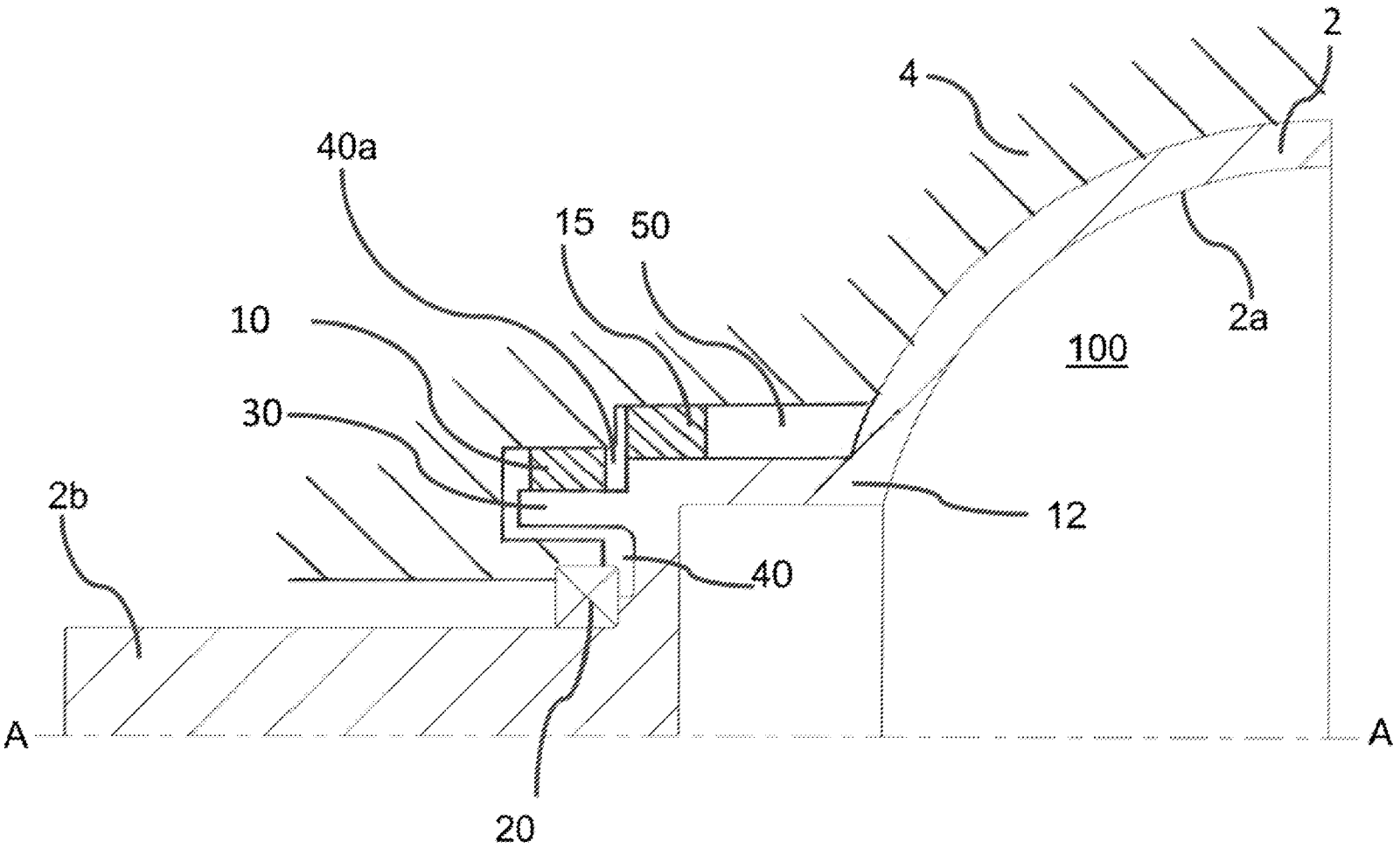

Turning to FIG. 7 in this embodiment two fluid seals 10 and 15 are shown. The seal 10 may be a lubricant seal, such as an oil seal, and is spaced apart by an intermediate space 40*a* from a working fluid or air seal 15. This serves to further enhance the desired separation of lubricant from working fluid or air along the interface region of the device. The fluid seal 10 is located on the land i.e. the radially outer surface of the annular wall 30.

Figure 8:
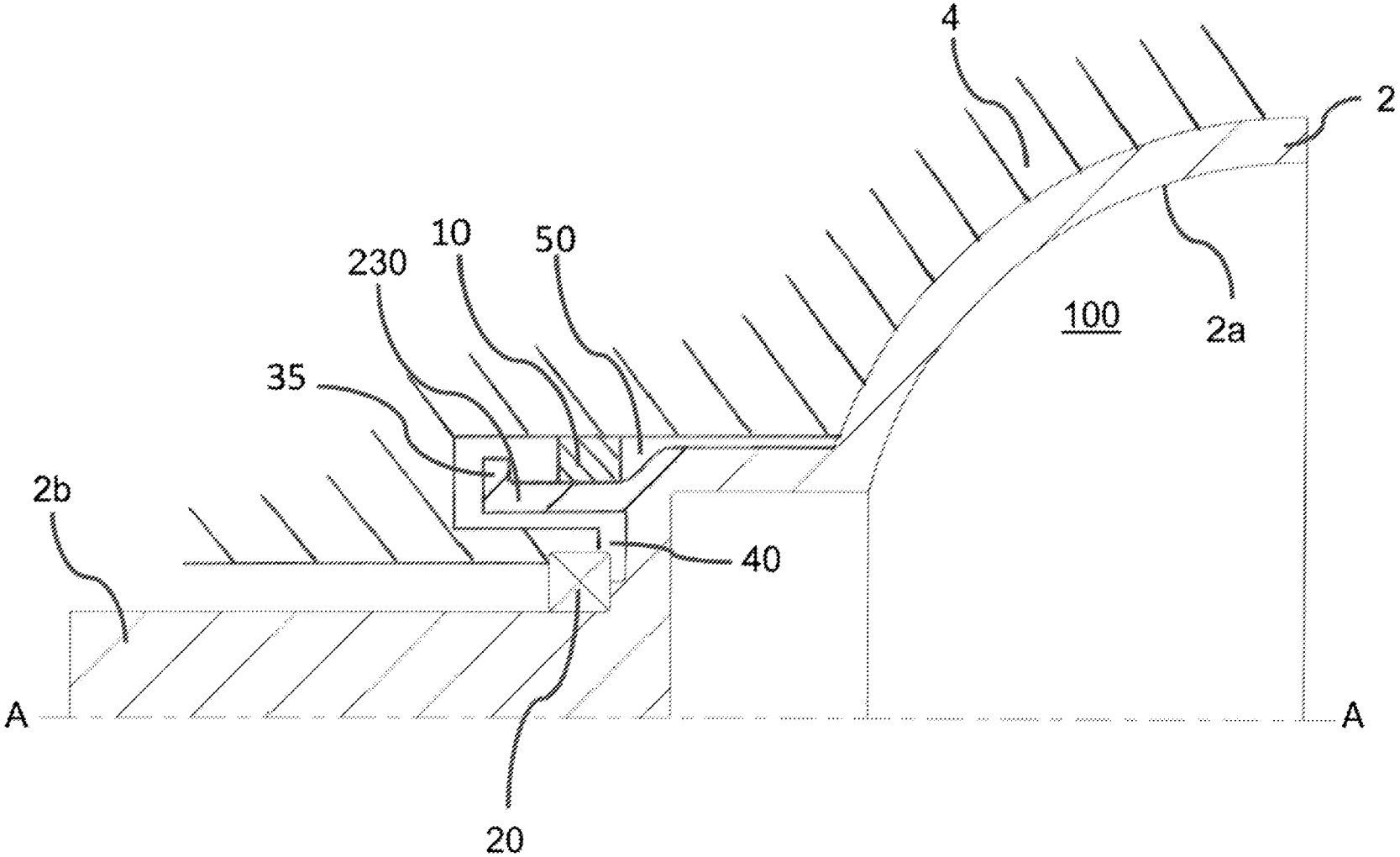

In the embodiment shown in FIG. 8 the annular seal 230 is provided with a flange or lip, serving as an oil flinger in use at its rearmost end.

Figure 9:
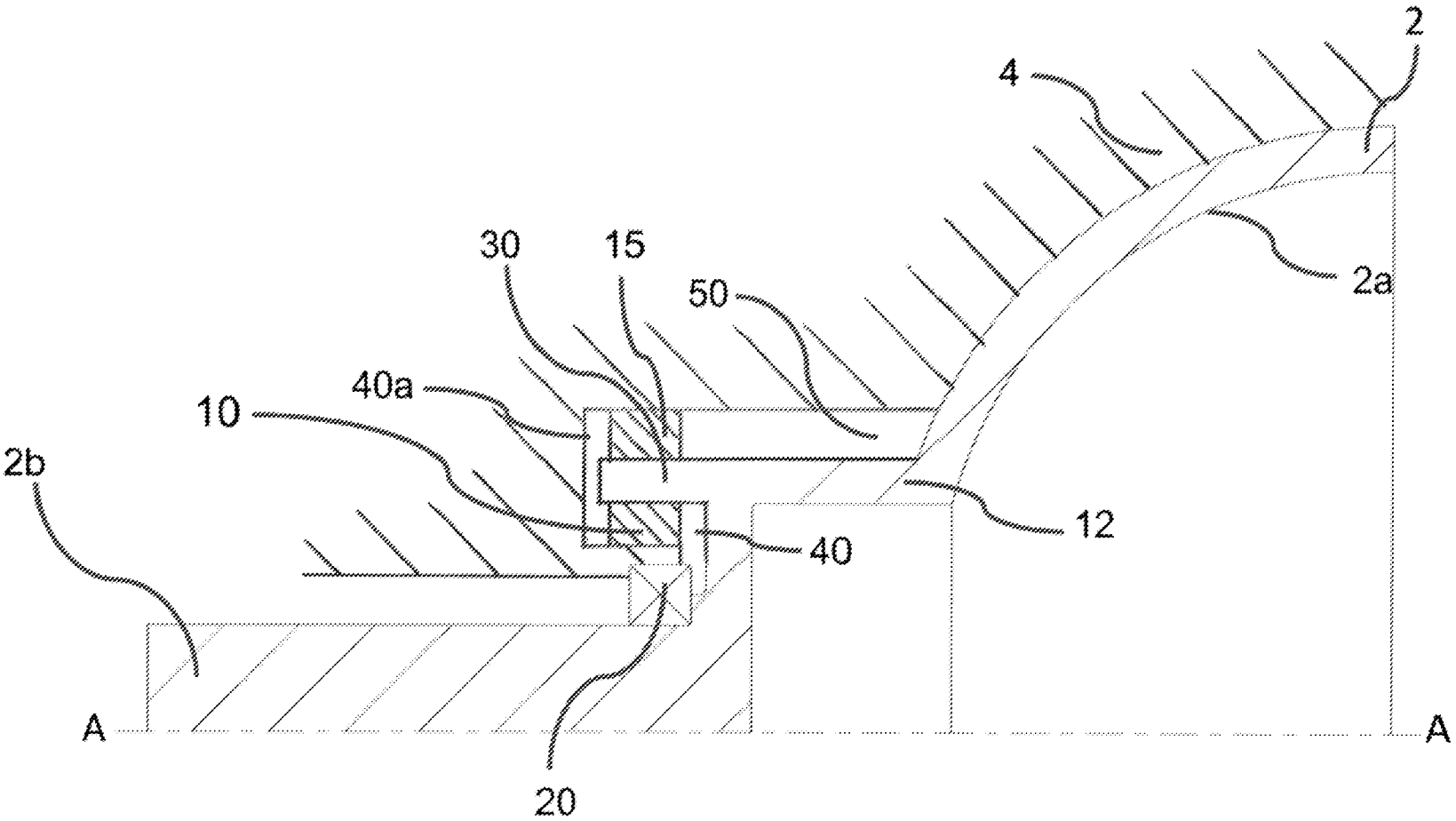

FIG. 9 shows an embodiment which being somewhat conceptually similar to the embodiment described above comprises two fluid seals, 10 and 15, which may be an oil seal and an air seal respectively, with an intermediate space 40*a* separating the two seals.

Figure 10:
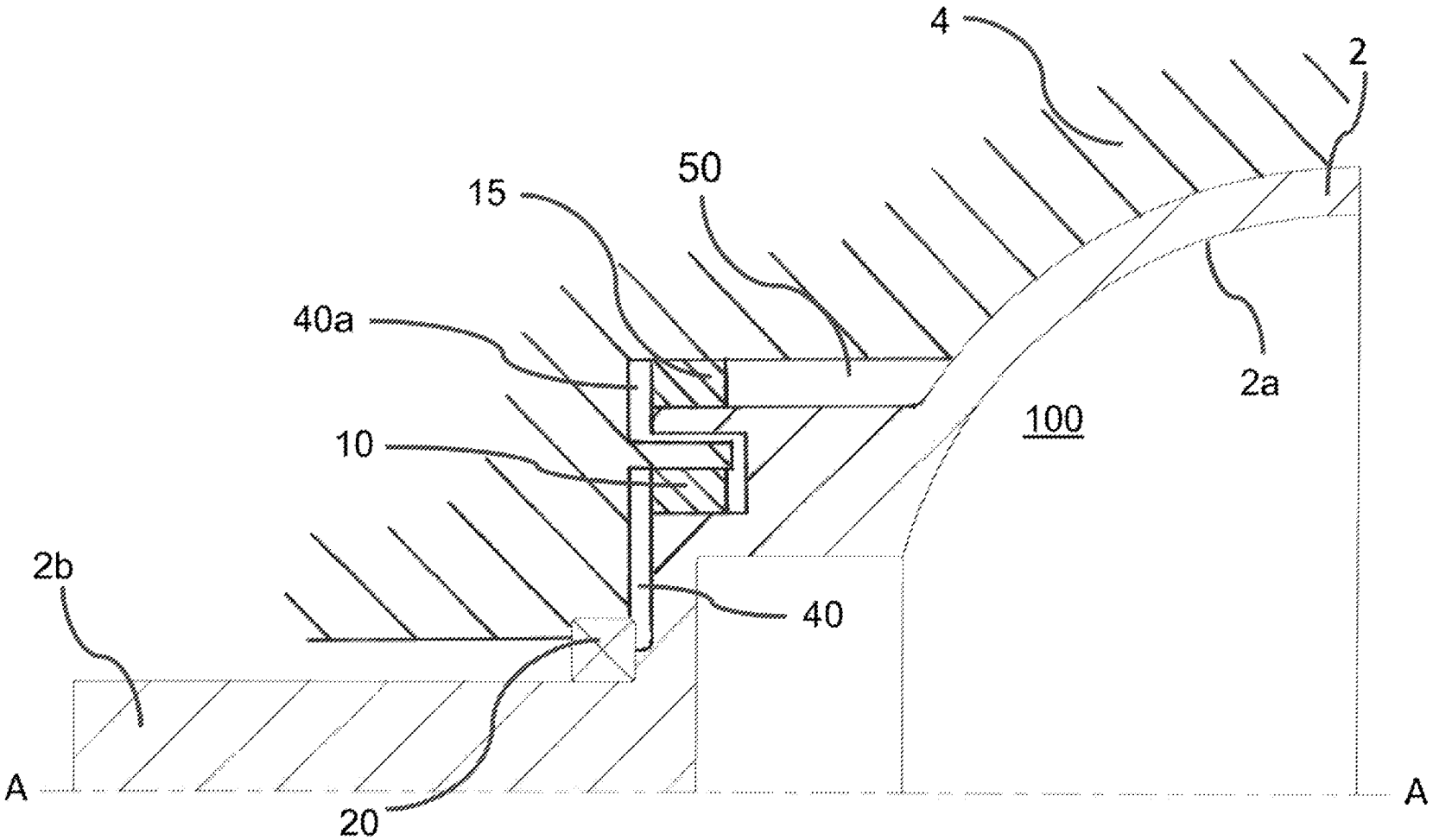

With reference to FIG. 10 there is again shown an embodiment in which two fluid seals, 10 and 15 are employed and being spaced apart by an intermediate space 40*a*. In this instance the space 40*a* is arranged to form a tortuous path thus assisting in inhibiting or preventing the ingress of oil towards the air seal 15.

Figure 11:
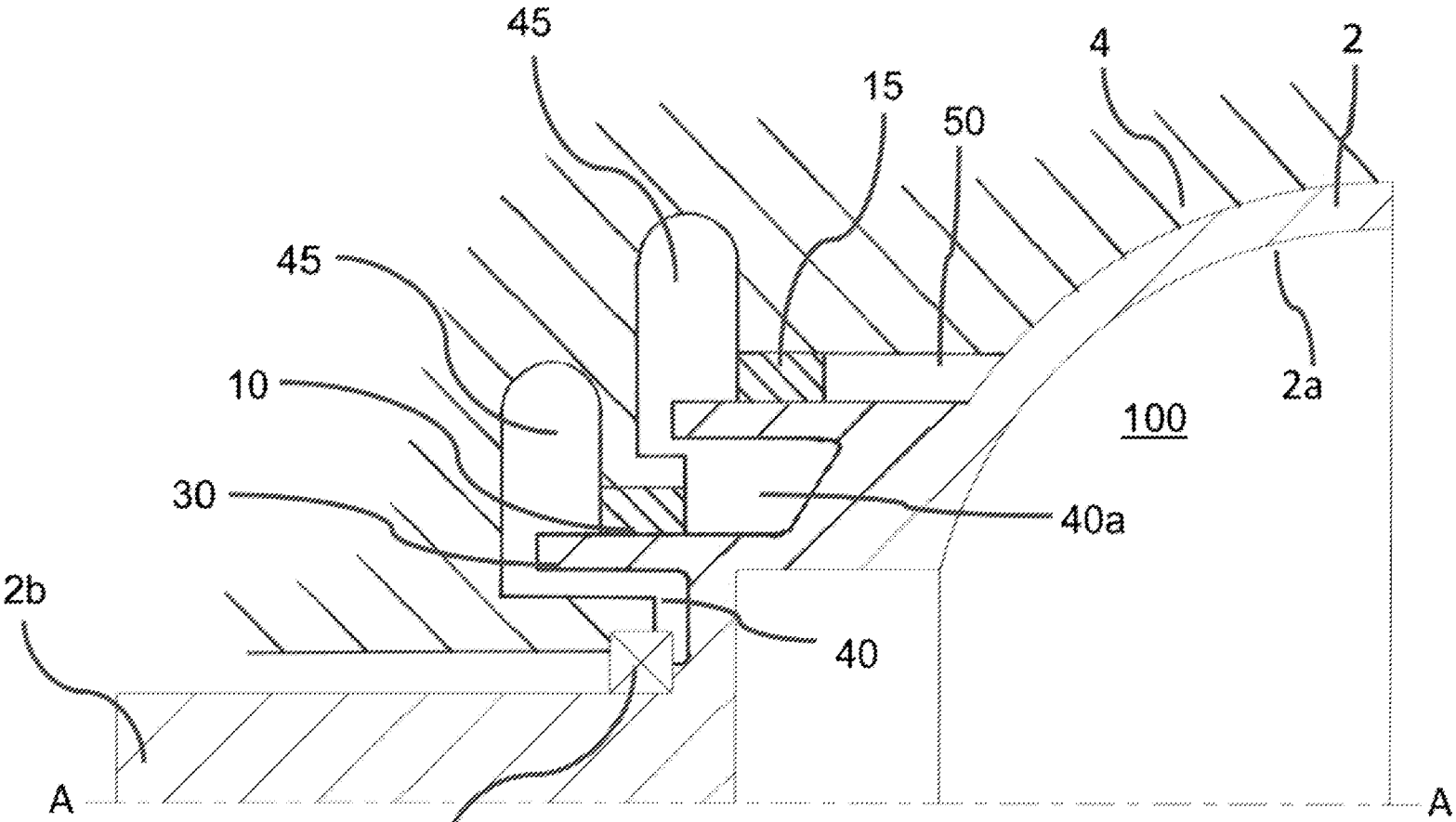

Turning to the embodiment shown in FIG. 11 this may be viewed as a hybrid of some of the previously described embodiments which as can be seen includes two fluid seals 10 and 15 arranged in series and separated by an intermediate space 40*a*. The intermediate space 40*a* and the intermediate space 40 both arranged to have a tortuous path and relative to each and associated with each of the oil seal 10 and the air seal 15 there is provided a fluid collection sub-chamber 45. It will be seen from FIG. 11 that the extent of this sub-chamber is positioned further radially outwardly than the corresponding radial position of its associated seal. This again assists with minimising any ingress or transgression of fluid towards or from the space 50.

Figure 12:
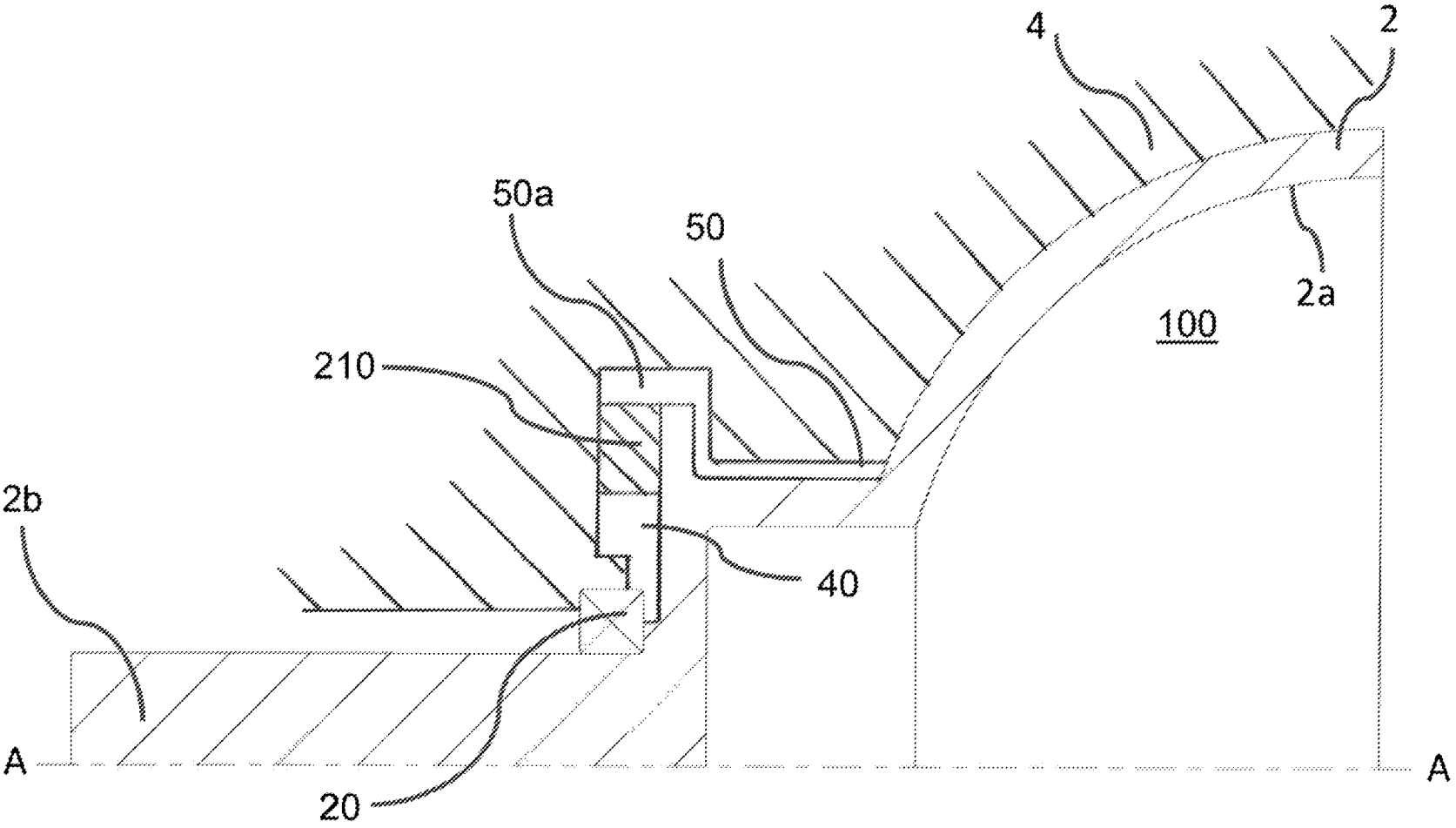
Figure 13:
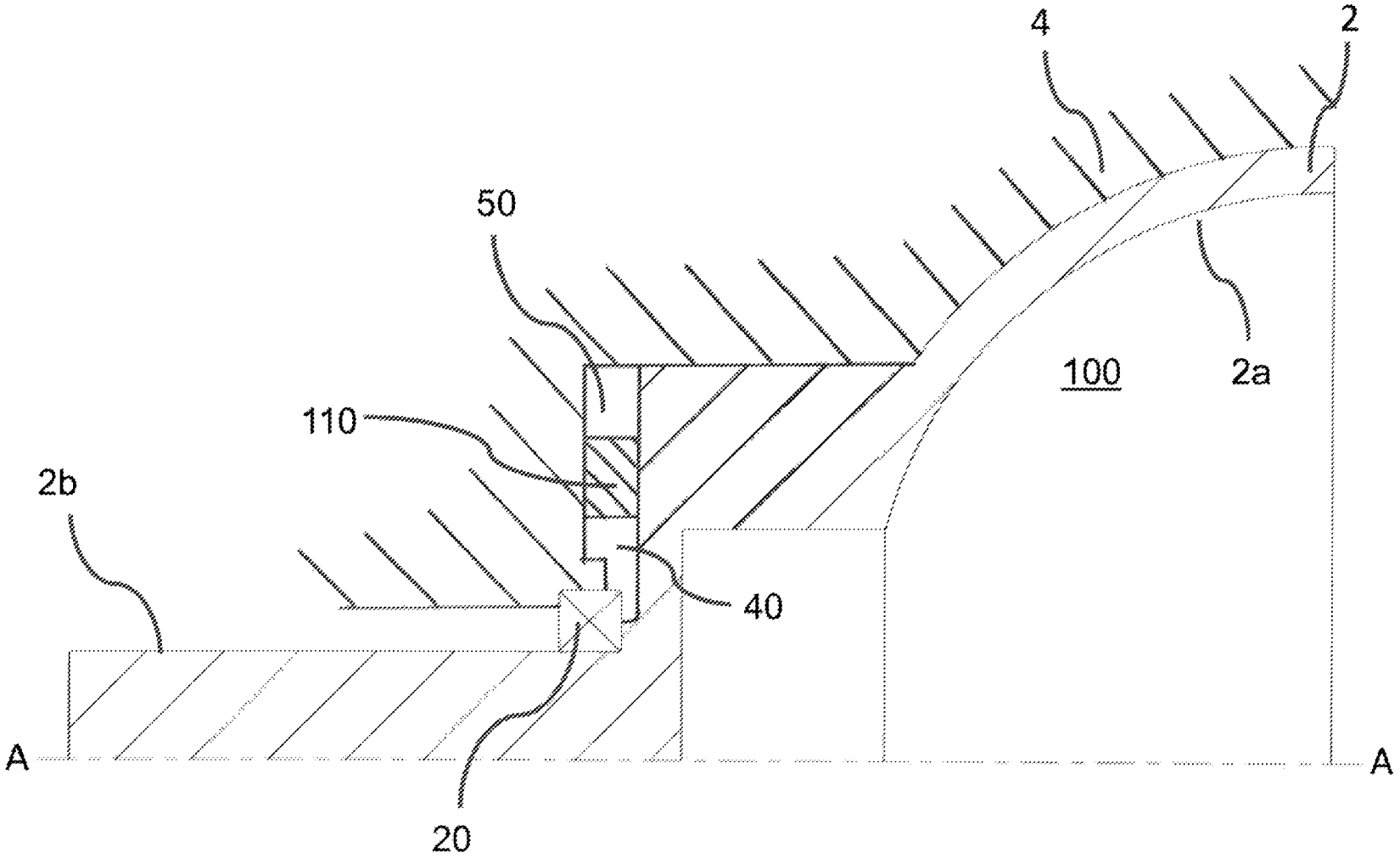

Reference is made to FIGS. 12 and 13 in which in both cases the intermediate space 40 is substantially radially disposed as is the oil seal 110. However the air space 50 of each differs in that the air space shown in FIG. 12 comprises a convoluted or tortuous arrangement of the space which comprises part 50*a* which is adjacent to the opposite side of the oil seal 110. Whereas in FIG. 13 the air space 50 does not include such an axially extending configuration and rather is disposed radially and adjacent to the oil seal 110. As can be seen, both the intermediate space and the seal partially axially overlap the bearing.

Figure 14:
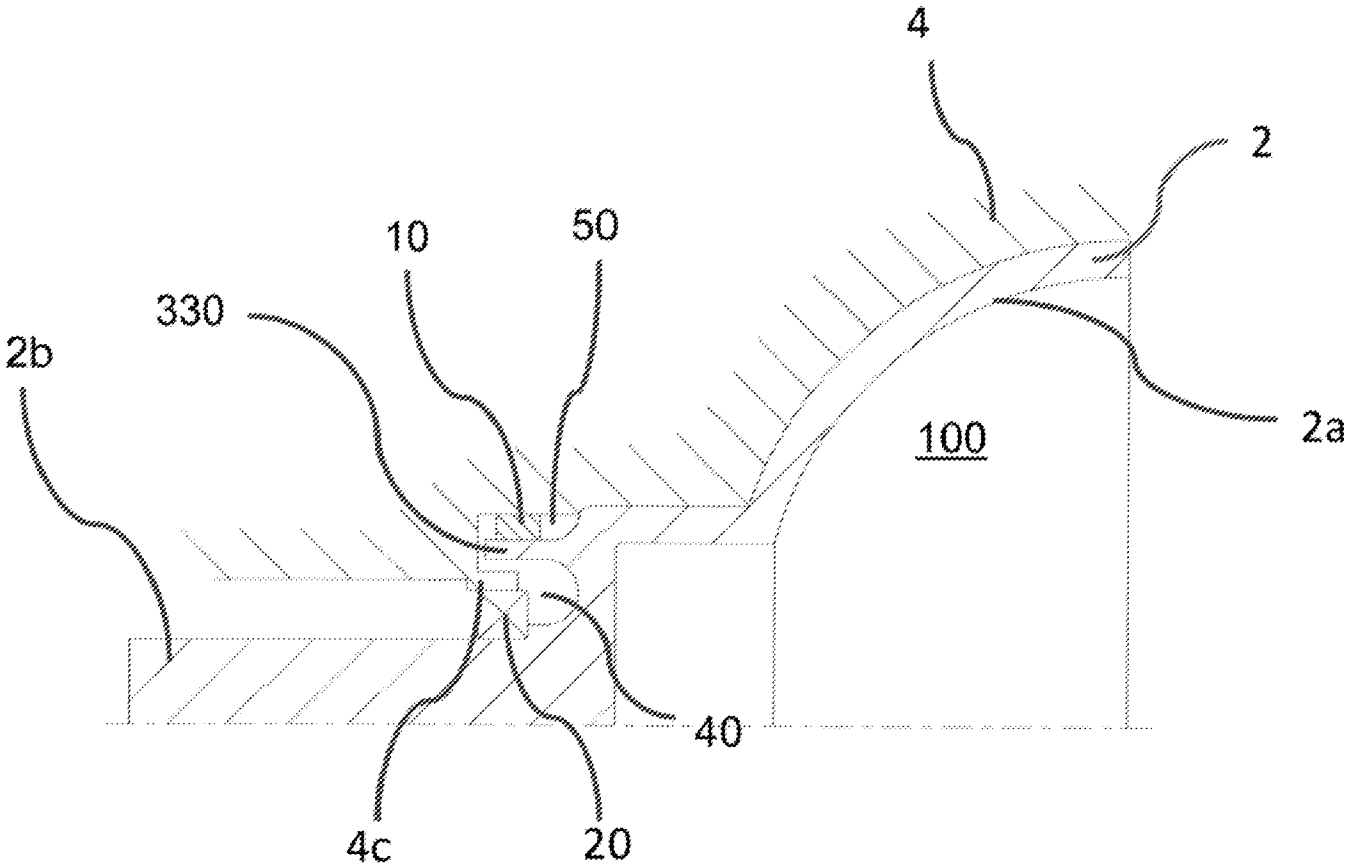

FIG. 14 shows yet a further embodiment in which the intermediate space allows for smoother curvature (in cross-section) on the bounding rotor surface, which may be described as a curved groove, which reduces the stress concentrations therein, increasing fatigue life of the part.

This embodiment also includes an annular/cylindrical formation 4*c* of the rotor which is located radially outwardly of the bearing 20.

Figure 15:
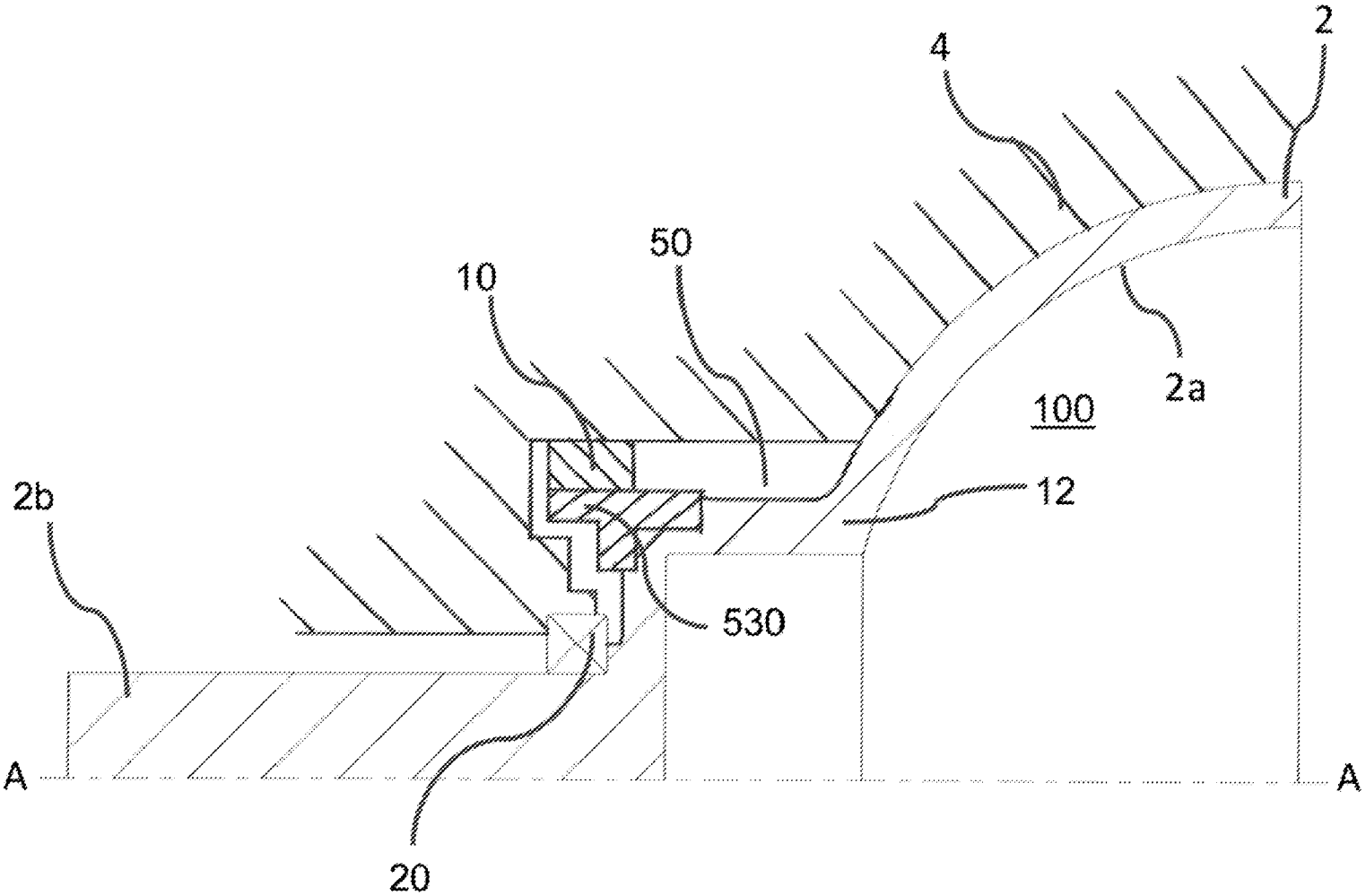

In FIG. 15 an embodiment is shown in which the annular wall feature is provided by a component 530. This component 530 is a separate component to the rotor at the time of manufacture and during an assembly process is attached to the portion 12 of the rotor. This may facilitate the manufacture of the rotor. The component 530 includes features and formation which allows location of it to the rotor and can be secured in place by a suitable fastening, so as to be able to cooperate and engage with a portion of the part 12, which may be a formed shoulder, of the rotor.

Figure 16:
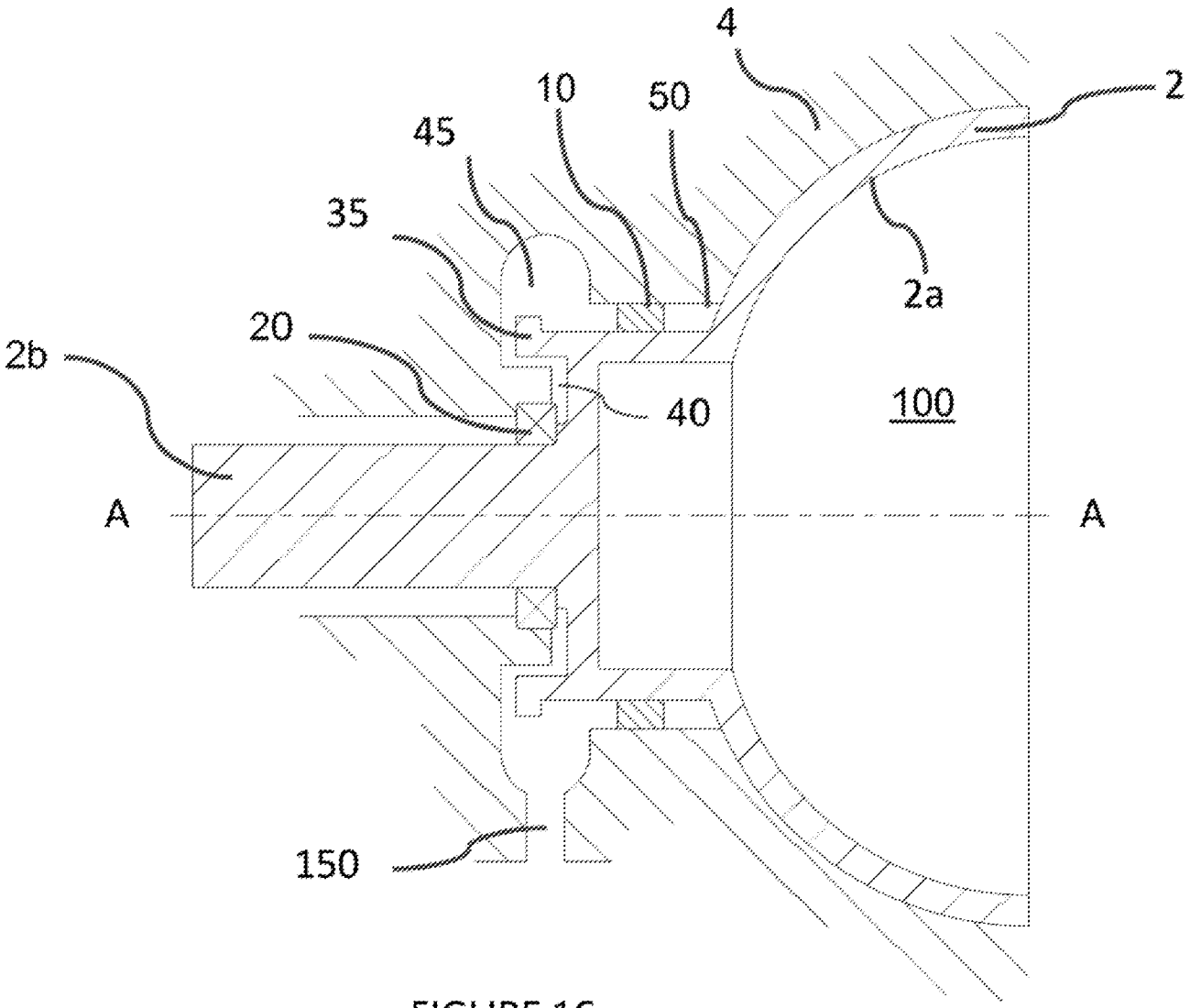
FIG. 16 shows a cross-section of a further embodiment.

FIG. 16 shows an embodiment which illustrates an example of the presence of a drain or outlet 150 to the oil collection chamber 45. Vents, such as air vents, may be also incorporated in a similar fashion in any of the previous embodiments, such as between the air and oil seals.

Advantageously, in respect of the above described embodiments, by arranging the seal and the bearing elements spaced apart from one another in a radial sense, allows for the bearing to be positioned closer to (the side of) the working chamber 100, in an axial direction. This is achieved by the presence of the annular formation of the rotor, which conveniently provides a land or surface for the seal, as well assisting in defining the space between rotor and stator, which defines a circuitous path between bearing and seal. In prior art devices, the bearing and seal are typically axially spaced along the shaft, in an axial direction, substantially at the same radial position from the axis of rotation. In the above embodiments, it has been realised that there can be substantial benefit from placing at least one or more of the bearings between the rotor and stator as close axially to the working chamber as possible. This novel arrangement advantageously reduces bearing loads.

Furthermore, the embodiments described above are novel arrangements in which the bearing and seal are spaced, at least in part, in a radial direction and in which in some cases part of the sealing system over-hangs either the bearing or a further seal. This can facilitate or avoid machining and manufacturing challenges (in terms of machine tool access/assembly etc) over the traditional arrangement, in addition to the advantage of reducing bearing loads.

Related to this, and perhaps viewed from a different perspective, is that the annular wall feature allows an increase in the available sealing area, without this resulting in having to locate the bearing further away from the chamber, and the disadvantages which would result from that.

Figure 17:
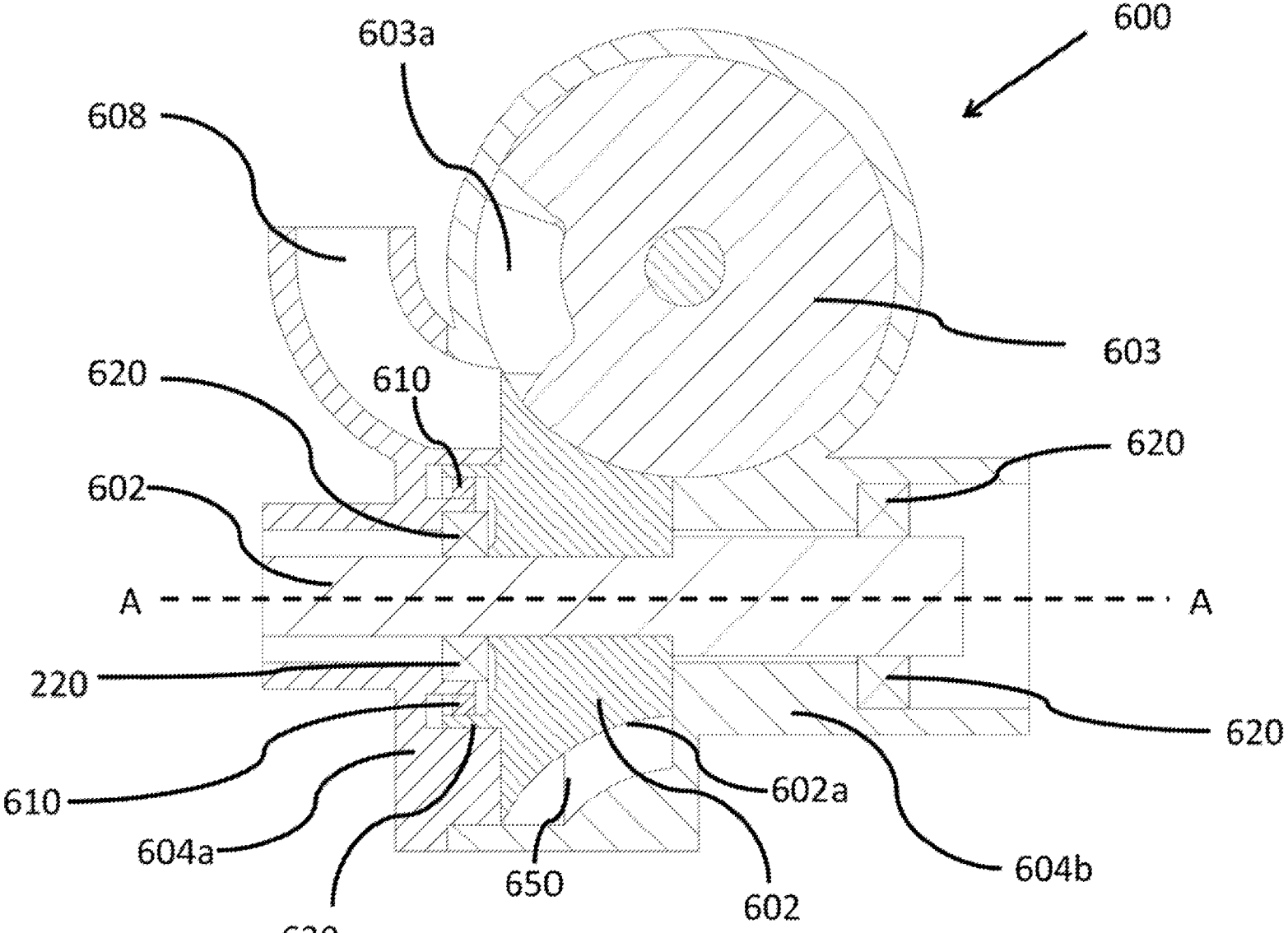
FIG. 17 shows a further embodiment of a different rotary piston and cylinder device.

Reference is made to FIG. 17, which shows a different type of rotary piston and cylinder device 600, which incorporates a further type of bearing and sealing arrangement as described above. The device 600 comprises a rotor, comprising a rotor surface 602*a*, a stator 4*a* and 4*b*, a rotatable shutter 603, a piston (not illustrated) which extends from the rotor surface, the rotor surface and the stator together defining an annular working chamber 650, and the piston, in use, arranged to rotate, through the annular chamber. A slot or aperture 603*a* is provided in the shutter 603. A characteristic of this type of device is that the rotor surface 602*a* is directed generally outwardly around the axis of rotor of the rotor 602. Moreover, the rotor surface could be termed as being Moreover, the rotor surface could be termed as being orientated at an incline with respect to a plane substantially perpendicular to the axis of rotation of the rotor, which plane extends through a mid-region of the rotor surface, and the rotor surface is directed generally away from the axis of rotation of the rotation of the rotor, or with respect to the axis of rotation of the rotor. The device 600 comprises two axially spaced bearing arrangements 620 to allow rotation of the rotor as supported by the stator. One of the bearing arrangements 620 is provided with an associated seal 610. As can be seen in FIG. 17, the seal 610 is radially spaced outward from the bearing 620. The rotor 602 comprises an annular/cylindrical wall/formation 630, which extends axially. The wall 630 provides a land or surface on which the seal 610 can be mounted or can act in conjunction with. The wall 630 could be said to extend rearwardly (of the rotor). The device 600 further comprises a port 608, incorporated into the stator.

Figure 18:
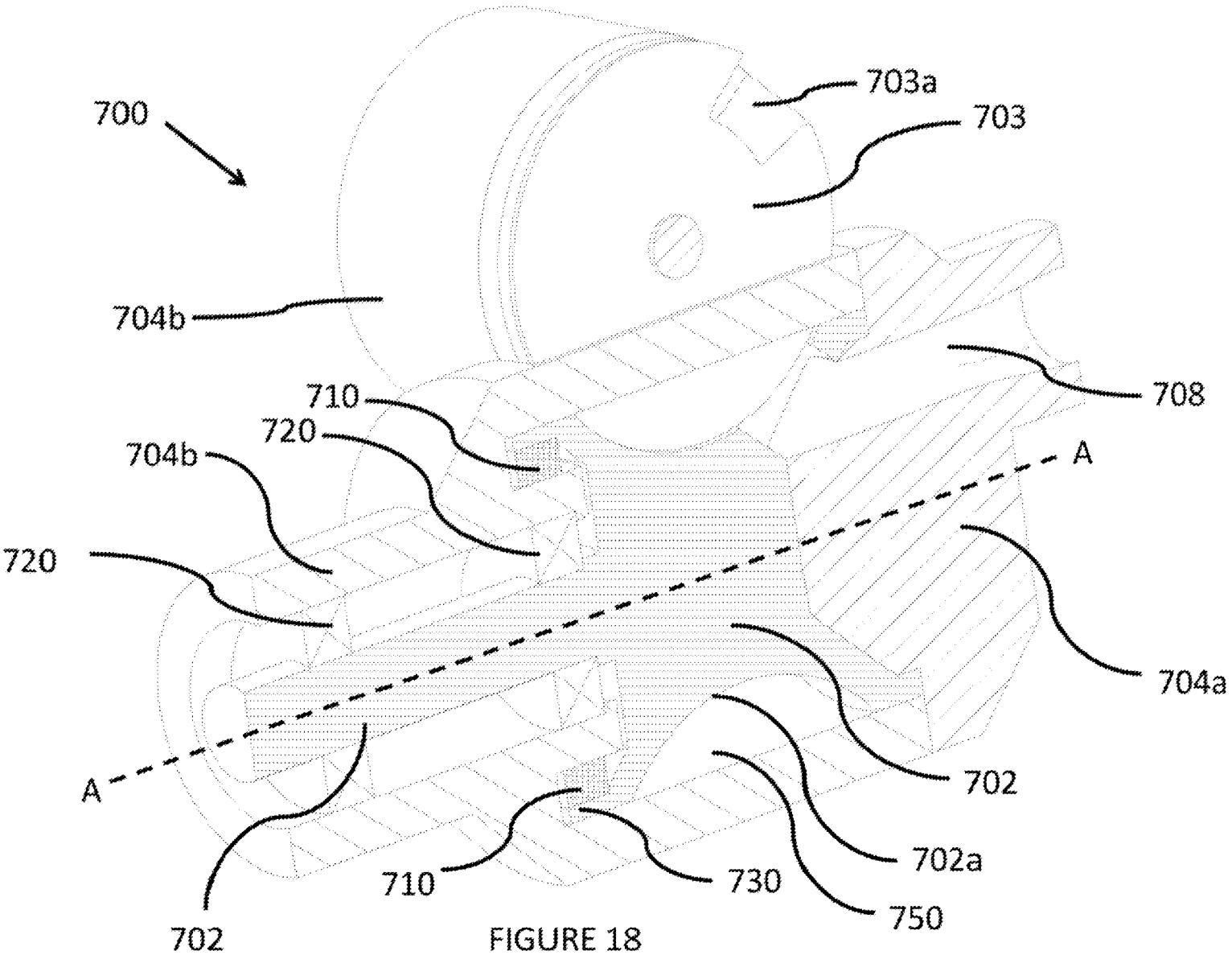
FIG. 18 shows yet a further embodiment of a different rotary piston and cylinder device.

Reference is made to FIG. 18 which shows yet a further type of rotary piston and cylinder device 700, which comprises a rotor 702, comprising a rotor surface 702*a*, a stator 4*a* and 4*b*, a rotatable shutter 703, a piston (not illustrated) which extends from the rotor surface, the rotor surface and the stator together defining an annular working chamber 750, and the piston, in use, arranged to rotate, through the annular chamber. A slot or aperture 703*a* is provided in the shutter 703. A characteristic of this type of device is that the rotor surface 702*a* is directed generally outwardly around the axis of rotor of the rotor 702. Moreover, the rotor surface could be termed as being orientated at orthogonally with respect to a plane substantially perpendicular to the axis of rotation of the rotor, which plane extends through a mid-region of the rotor surface, and the rotor surface is directed generally away from the axis of rotation of the rotation of the rotor, or with respect to the axis of rotation of the rotor. The rotor surface 702*a* may be described as substantially diablo shape, in which the concave profile of the rotor surface is rotated around the axis of rotation of the rotor. The device 700 comprises two axially spaced bearing arrangements 720 to allow rotation of the rotor as supported by the stator. One of the bearing arrangements 720 is provided with an associated seal 710. As can be seen in FIG. 17, the seal 710 is radially spaced outward from the bearing 720. The rotor 702 comprises an annular/cylindrical wall/formation 730, which extends axially. The wall 730 provides a land or surface on which the seal 710 can be mounted or can act in conjunction with. The wall 730 could be said to extend rearwardly (of the rotor).

What is claimed is:

1. A rotary piston and cylinder device comprising a rotor, a stator and a rotatable shutter, the rotor including a piston which extends from the rotor into a working chamber, the rotor and the stator together defining the working chamber, the rotatable shutter arranged to extend through the working chamber and forming a partition therein, and the rotatable shutter including a slot which allows passage of the piston therethrough, a bearing which mounts the rotor relative to the stator, the rotor including a formation which extends substantially axially away from the working chamber, and the formation being radially outward of the bearing and extending around the axis of rotation, and the formation including a surface which at least in part defines a space between the rotor and the stator, and at least part of that space and/or the formation overlaps in an axial direction with the bearing.

2. The rotary piston and cylinder device as claimed in claim 1 in which the formation comprises an annular or cylindrical formation.

3. The rotary piston and cylinder device as claimed in claim 2 in which the annular or cylindrical formation is provided rearwardly of the working chamber.

4. The rotary piston and cylinder device as claimed in claim 2 in which the annular or cylindrical formation comprises a land.

5. The rotary piston and cylinder device as claimed in claim 4 in which the land provides a locating surface for a seal, or a surface which serves to act with the seal.

6. The rotary piston and cylinder device as claimed in claim 2 in which the annular or cylindrical formation comprises a flange or a lip.

7. The rotary piston and cylinder device as claimed in 6 in which the annular or cylindrical formation comprises a portion which, in use, is operative to serve as a lubricant flinger or lubricant distributor.

8. The rotary piston and cylinder device as claimed in claim 1 which comprises a lubricant collection chamber, which is defined at least in part by an annular groove or channel, extending about the axis of rotation.

9. The rotary piston and cylinder device as claimed in claim 1 which comprises a fluid seal arranged in communication with the space.

10. The rotary piston and cylinder device as claimed in claim 9 in which the fluid seal is located outwardly with respect to the axis of rotation and spaced from the bearing in a direction from the axis.

11. The rotary piston and cylinder device as claimed in claim 9 in which the fluid seal is substantially in its entirety, offset from the bearing in a radial sense relative to the axis of rotation of the rotor.

12. The rotary piston and cylinder device as claimed in claim 9 in which the bearing is arranged in communication with the space.

13. The rotary piston and cylinder device as claimed in claim 9 in which the fluid seal and the bearing are located rearwardly of, or behind, or to a side of, when viewed in axial cross-section, from the working chamber.

14. The rotary piston and cylinder device as claimed in claim 9 in which the fluid seal and the bearing are located, at least in part, at different axial positions or regions relative to the extent of the axis of rotation of the rotor.

15. The rotary piston and cylinder device as claimed in claim 9 wherein the fluid seal comprises multiple fluid seals.

16. The rotary piston and cylinder device as claimed in claim 9 in which the fluid seal is arranged to substantially maintain an oil-air barrier.

17. The rotary piston and cylinder device as claimed in claim 9 in which the space comprises a labyrinth seal.

18. The rotary piston and cylinder device as claimed in claim 9 in which the bearing and the fluid seal are located between opposing surfaces of the rotor and the stator.

19. The rotary piston and cylinder device as claimed in claim 1 in which the space is arranged to contain a lubricant.

20. The rotary piston and cylinder device as claimed in claim 1 in which the space is defined at least in part by an annular groove.

* * * * *